US007731452B2

(12) United States Patent
Yodock, III et al.

(10) Patent No.: US 7,731,452 B2
(45) **Date of Patent: *Jun. 8, 2010**

(54) FLOATING BARRIER UNITS

(76) Inventors: Leo J. Yodock, III, 1775 Fifth Street Hollow Rd., Bloomsburg, PA (US) 17815; Leo J. Yodock, Jr., 44 Duke of Gloucester St., Bloomsburg, PA (US) 17815; Guy C. Yodock, 5871 8 Point La., Lakeland, FL (US) 33811

( * ) Notice: Subject to any disclaimer, the term of this patent is extended or adjusted under 35 U.S.C. 154(b) by 0 days.

This patent is subject to a terminal disclaimer.

(21) Appl. No.: 12/033,313

(22) Filed: Feb. 19, 2008

(65) Prior Publication Data

US 2008/0267710 A1 Oct. 30, 2008

Related U.S. Application Data

(63) Continuation of application No. 11/320,382, filed on Dec. 28, 2005, now Pat. No. 7,407,341, which is a continuation-in-part of application No. 10/119,130, filed on Apr. 2, 2002, now abandoned.

(51) Int. Cl.
*E02B 15/06* (2006.01)

(52) U.S. Cl. ..... 405/72; 405/70

(58) Field of Classification Search ..... 405/23, 405/26, 60, 61, 63, 65, 66, 67, 70, 71, 72; 404/6, 9; 114/240 R, 240 C, 240 D, 240 E; 256/13.1; 116/63 R, 63 P, 107; 40/607.1
See application file for complete search history.

(56) References Cited

U.S. PATENT DOCUMENTS

| | | | |
|---|---|---|---|
| 3,685,297 | A | 8/1972 | Joudis et al. |
| 4,043,131 | A | 8/1977 | Sessions |
| 4,059,362 | A | 11/1977 | Smith |
| 4,391,077 | A | 7/1983 | Giess |
| 4,406,241 | A | 9/1983 | Comte |
| 4,543,012 | A | 9/1985 | Riley |
| 4,681,302 | A | 7/1987 | Thompson |
| 4,715,307 | A | 12/1987 | Thompson |
| 4,773,629 | A | 9/1988 | Yodock |
| 4,946,306 | A | 8/1990 | Yodock |
| 5,006,014 | A | 4/1991 | Greenough |

(Continued)

FOREIGN PATENT DOCUMENTS

| | | | |
|---|---|---|---|
| CH | 679227 | A5 | 1/1992 |

(Continued)

*Primary Examiner*—Michael Safavi
(74) *Attorney, Agent, or Firm*—GrayRobinson, P.A.

(57) ABSTRACT

A number of individual barrier units form a floating barrier wall each comprising a housing formed in the general shape of a highway barrier having a top wall, a bottom wall, opposed end walls, and, opposed side walls interconnected to form a hollow interior which is preferably partially or completely filled with a foam material. A ballast weight is secured to each barrier unit, either inside or outside of the hollow interior, to maintain them in an upright position in the water. Cables, couplers and/or other connectors are employed to mount adjacent barrier units end-to-end to form a barrier wall which can encircle a vessel or otherwise isolate an area within a seaport or other body of water to provide security.

4 Claims, 19 Drawing Sheets

U.S. PATENT DOCUMENTS

| | | | |
|---|---|---|---|
| 5,123,773 | A | 6/1992 | Yodock |
| 5,152,636 | A | 10/1992 | Myers |
| 5,355,825 | A | 10/1994 | Lefebvre et al. |
| 5,439,315 | A | 8/1995 | MacKenzie et al. |
| 5,498,101 | A | 3/1996 | Braverman |
| 5,531,540 | A | 7/1996 | Wasserstrom et al. |
| 5,605,413 | A | 2/1997 | Brown |
| 5,875,729 | A | 3/1999 | Simola |
| 5,882,140 | A | 3/1999 | Yodock, Jr. et al. |
| 2004/0115002 | A1 | 6/2004 | Meeks et al. |

FOREIGN PATENT DOCUMENTS

| | | | |
|---|---|---|---|
| DE | 2533913 | A | 2/1977 |
| GB | 2250720 | A | 6/1992 |
| WO | 02/42047 | A2 | 5/2002 |
| WO | 2004/096637 | A2 | 11/2004 |

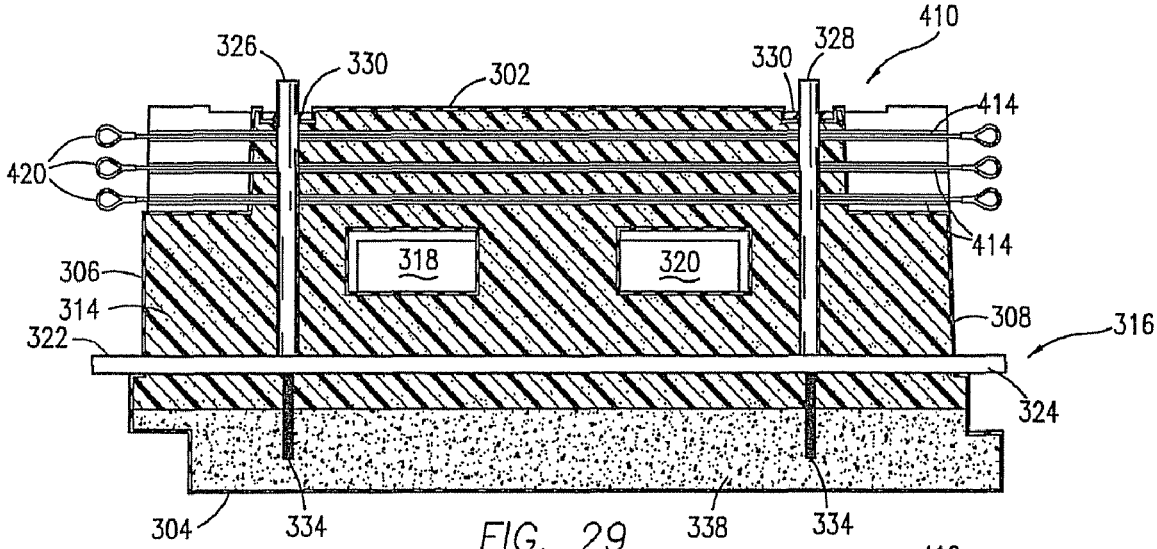
FIG. 29
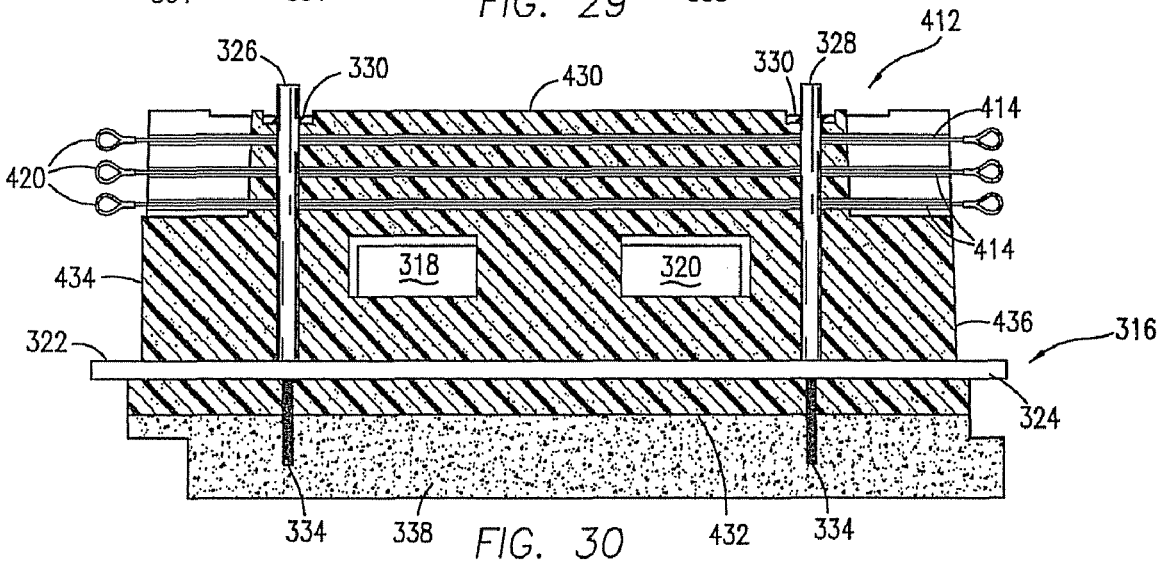
FIG. 30
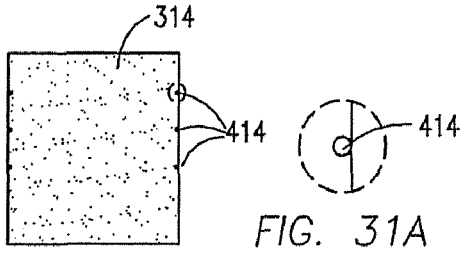
FIG. 31A
FIG. 31

FLOATING BARRIER UNITS

RELATED APPLICATION

This application is a continuation of U.S. application Ser. No. 11,320,382, filed Dec. 28, 2005 and entitled "Floating Barrier Wall," which is a continuation-in-part of U.S. patent application Ser. No. 10/119,130, filed Apr. 2, 2002 and entitled "Floating Barrier Wall."

FIELD OF THE INVENTION

This invention relates to a barrier system for the protection of vessels and other assets located in or around bodies of water, and, more particularly, to floating barrier units each formed of a light weight plastic having a hollow interior, a ballast weight located inside and/or outside of the hollow interior in position to maintain the units in an upright orientation in the water, and, an internal reinforcing member having a coupling element at opposite ends allowing adjacent barrier units to be connected end-to-end to form a floating barrier wall.

BACKGROUND OF THE INVENTION

The security of vessels, both military and commercial, as well as other assets located in and around seaports, has been of increasing concern in the wake of activities by terrorists and others. Most security efforts have focused on potential land-based attacks, and little attention has been devoted to the provision of an effective deterrent to assaults from floating objects, vessels or other water-based threats.

A vessel anchored at port to take on fuel or supplies is particularly vulnerable to attack. Although radar, sonar and other sensors can remain active and manned during these periods, no evasive action could be taken in a short period of time to avoid a water-born attack. One option for military vessels is to remain on alert while anchored, with guns manned, but in busy seaports it may be difficult to discern between harmless commercial traffic and a potential attacker. At present, there is no system which is visible in the water for effectively defining an area of restricted access and to warn other vessels to stay away from a military or commercial ship at anchor. Buoys, channel markers and the like which are commonly found in the water at seaports are not suitable for use as a warning device because they have not historically been used for such purpose and would not be perceived in that way by vessel operators. As a consequence, it is conceivable that an innocent commercial vessel could be fired upon by an anchored military ship for entering restricted space defined by buoys or other markers because the vessel operator did not realize the buoys or markers were being used for that purpose.

In addition to ships, other ocean-based assets may be vulnerable to attack from water borne threats. For example, oil platforms are commonly employed to drill for petroleum beneath the ocean floor and these stationary assets are particularly susceptible to attack from a vessel.

SUMMARY OF THE INVENTION

This invention is directed to floating barrier units each comprising a top wall, a bottom wall, opposed end walls and opposed side walls interconnected to form a hollow interior which may be partially filled with a foam material. A ballast weight is provided inside and/or outside of the hollow interior of the barrier units to maintain them in an upright position in the water. A reinforcing member, mounted within the hollow interior of the housing, includes a coupling element at each end so that adjacent barrier units can be mounted end-to-end to form a barrier wall which can encircle a vessel, an oil rig or otherwise isolate an area within a seaport or other location in the water to provide security.

This invention is predicated upon the concept of creating a floating wall of interconnected barrier units which can be readily recognized by operators of vessels and others as a warning structure delineating a restricted area. In the presently preferred embodiment, the individual barrier units are a modified version of plastic structures which have been conventionally used as highway barriers of the type disclosed, for example, in U.S. Pat. No. 5,882,140. Each barrier is formed in the general shape of a "New Jersey" style concrete highway barrier, with side walls having a curb reveal extending vertically upwardly from A relatively wide bottom wall, an angled section extending inwardly from the curb reveal and a vertical section located between the angled section and top wall. Although not previously used in water-based applications, barriers of this shape are readily recognized as defining areas of restricted or no access.

A number of features are included in the barrier units of this invention to adapt them for use in water security applications. In one embodiment, the hollow interior of each barrier unit is provided with a layer of foam material which extends from the top wall to a layer of concrete located along the bottom wall within the hollow interior which forms a ballast weight. Alternatively, the ballast weight can be mounted to the bottom wall of each unit, exteriorly of the hollow interior, with the foam layer completely filling the hollow interior. A reinforcement member extends through the foam layer between the end walls of the housing, and mounting posts are inserted through holes in the top wall into engagement with the reinforcement member. A connector mounted to the ballast weight secures the mounting post(s) to the reinforcement member.

In the presently preferred embodiment, each mounting post is a hollow tube having an upper portion protruding from the hollow interior of the barrier unit which is capable of mounting a variety of accessory items. For example, the mounting posts can support a fence, sign, lights, motion sensors, radiation detectors and other items.

Each end of the reinforcement member protrudes from an end wall of a barrier unit. A coupling element is carried by such ends, and the coupling element of one barrier unit is connected to the coupling unit of an adjacent barrier unit to form a wall of barrier units oriented end-to-end. As discussed below, different embodiments of the coupling element are disclosed, each of which is characterized by the use of parts which can be readily removed from the barrier units when worn and replaced by new parts to reduce maintenance time and cost.

It is contemplated that the barrier units of this invention may be transported aboard ship for deployment at locations where the ship may dock. In order to reduce the weight of the barrier units, alternative versions of the ballast weight employed are provided. In one presently preferred embodiment, the foam layer within the hollow interior of each barrier unit extends from the top wall but stops short of the bottom wall defining a cavity between the foam layer and bottom wall. One or more holes are formed in the housing to permit the flow of water into the cavity when the barrier unit is placed in the water. The water acts as a ballast weight to orient the barrier units such that the top wall remains out of the water and the bottom wall submerged. If additional ballast is needed, a layer of concrete or a metal plate may be provided along the bottom wall of the housing, either within its hollow interior or externally thereof, to form a second ballast weight.

In an alternative embodiment, the ballast weight comprises a body formed of a porous ballast material which is inserted within the hollow interior of each barrier unit between its top and bottom walls leaving an open cavity extending from the porous body to the top wall. The surface of the ballast weight which faces the top wall of the barrier unit is impermeable to water to isolate the cavity. One or more openings in the housing allow water to impregnate the porous body and provide the needed ballast weight. If additional ballast is desired, a second ballast weight formed of concrete or metal, as described above, may be employed.

DESCRIPTION OF THE DRAWINGS

The structure, operation and advantages of the presently preferred embodiment of this invention will become further apparent upon consideration of the following description, taken in conjunction with the accompanying drawings, wherein:

FIG. 29 is a front view of a barrier unit similar to that shown in FIG. 2, except with a number of cables extending through the interior thereof from end-to-end;

FIG. 30 is a view similar to FIG. 29 except with the cables located within seats formed in a side wall of the barrier;

FIG. 31 is a partial side view of the barrier units of FIGS. 29 and 30; and FIG. 31A is an enlargement of the circled portion of FIG. 31.

DETAILED DESCRIPTION OF THE PREFERRED EMBODIMENT

Figure 1:
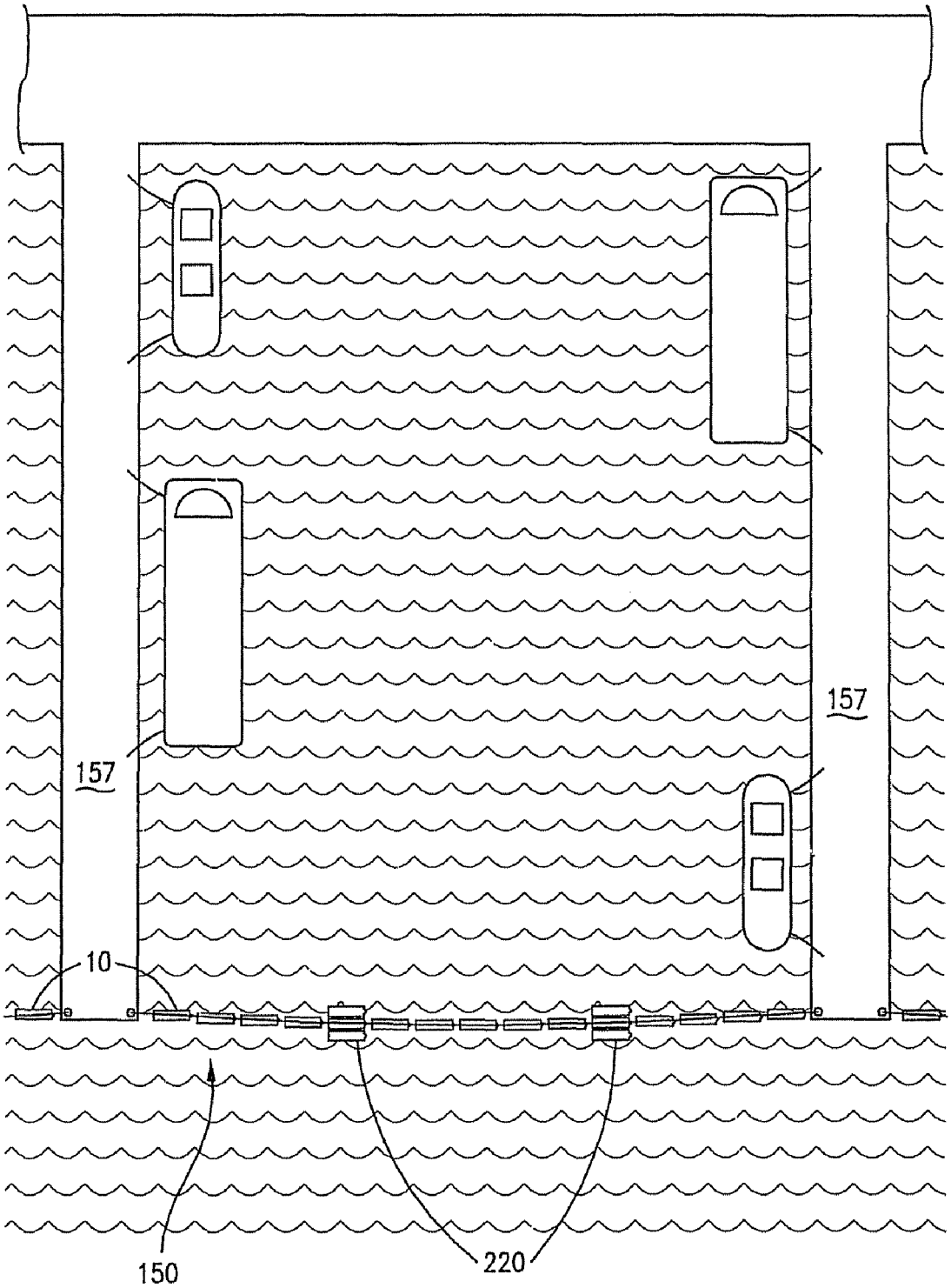
FIG. 1 is a schematic plan view of a representative installation for the barrier wall of this invention in which individual barrier units carry a cable whose ends are each anchored to a pier defining an enclosed body of water where vessels are moored.

A number of alternative embodiments of barrier units according to this invention are depicted in the drawings, and there are different means of interconnecting adjacent barrier units to form a barrier wall depending on their construction. Notwithstanding certain structural variations in the several embodiments of the barrier units herein, as discussed below, common elements are present in each of the preferred embodiments. The description which follows discusses each embodiment of the barrier units of this invention separately, with common structure identified with the same reference numbers in the Figs. The means for connecting adjacent barriers is also described separately below.

Barrier Unit of FIGS. 2-6

Figure 2:
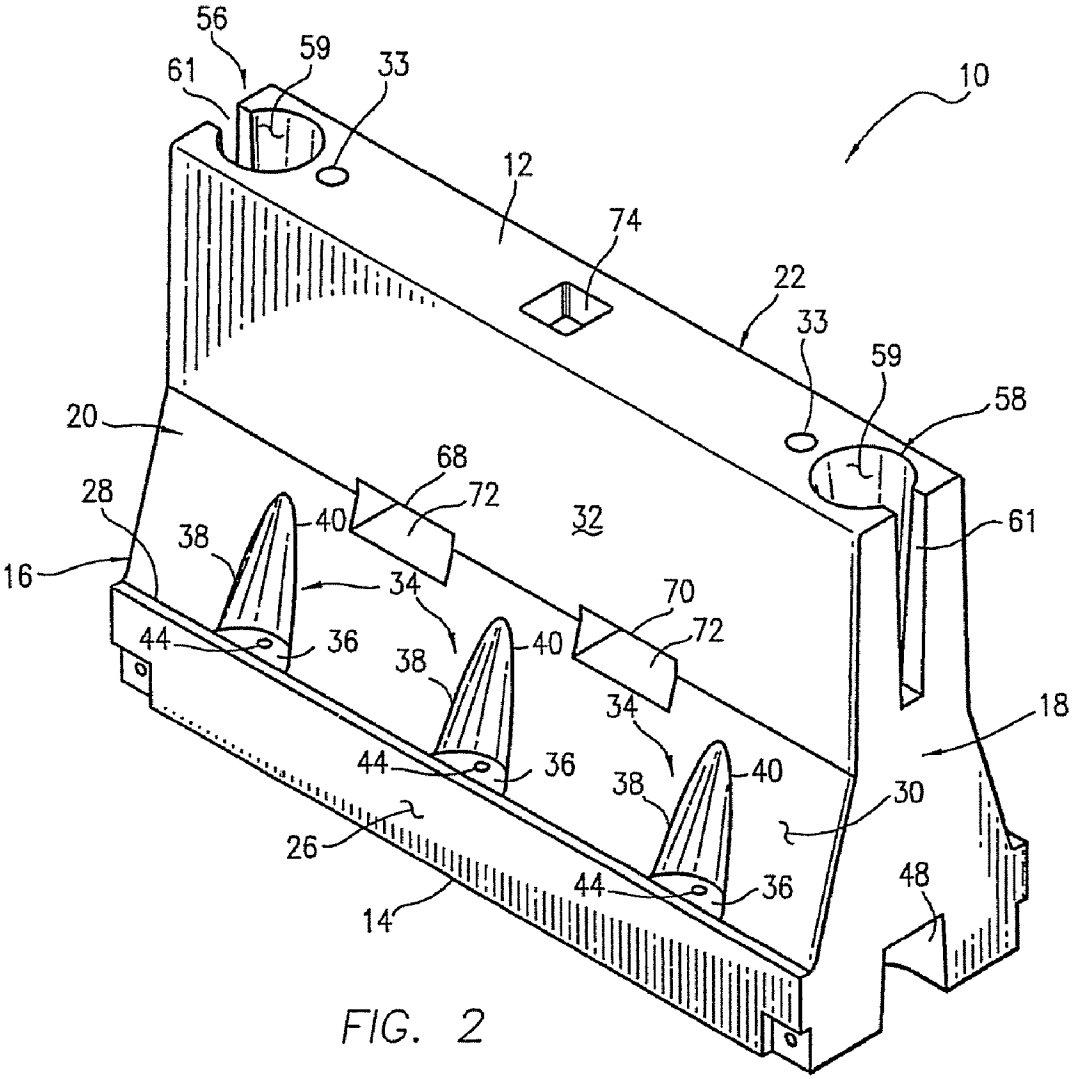
FIG. 2 is a perspective view of one embodiment of an individual barrier unit of this invention.
Figure 3:
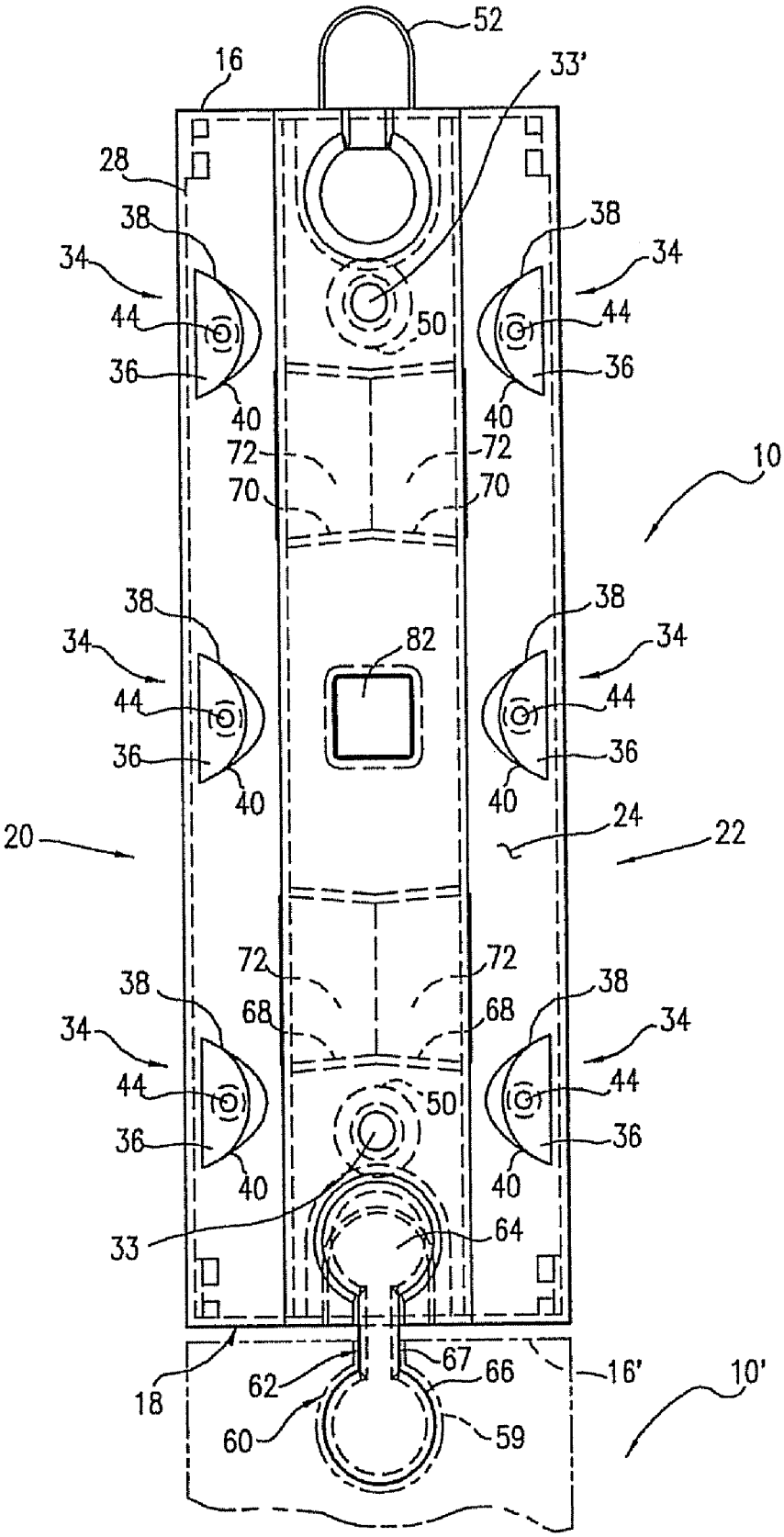
FIG. 3 is a plan view of the barrier unit depicted in FIG. 1, with a portion of a second barrier shown in phantom at one end.
Figure 4:
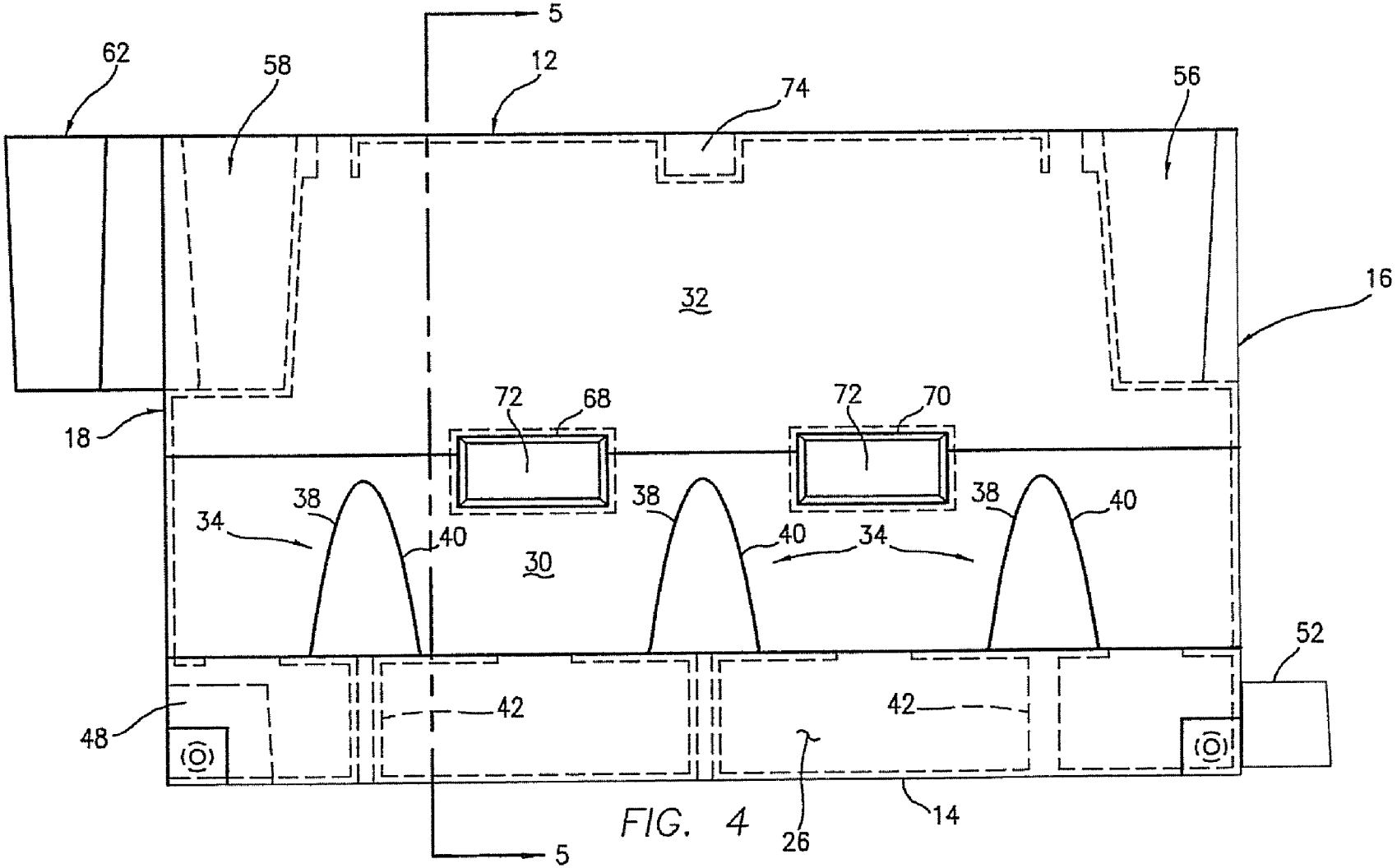
FIG. 4 is a side view of the barrier unit of FIG. 2.

Referring initially to FIGS. 2-4, each individual barrier unit 10 in this embodiment of the invention comprises a top wall 12, a bottom wall 14, opposed end walls 16, 18, and, opposed side walls 20, 22 which are interconnected to collectively define a hollow interior 24. In the presently preferred embodiment, each of the walls 12-22 are formed of a semi-rigid plastic material chosen from the group consisting of low density polyethylene, high density polyethylene, acrylonitrile or butadiene styrene, high impact styrene, polycarbonates and the like. These plastic materials are all inherently tough, exhibit good energy absorption characteristics, are generally unaffected by weather and have excellent basic resistance to leaching and biodegradation. Materials such as ultraviolet inhibitors can be added to such plastic materials, making them further resistant to the effects of weather. They also retain their mechanical and chemical properties at low ambient temperatures.

In the embodiment of FIGS. 2-4, the walls 12-22 of barrier unit 10 have a thickness in the range of about one-eighth inch to one inch so as to perform satisfactorily in service, as described in more detail below. The barrier units 10 are preferably in the range of about six to eight feet in length, and, at the wall thickness noted above, have a weight when empty of about 75 to 130 lbs.

Considering initially the construction of the side walls 20, 22 of a barrier unit 10, since both are identical in configuration only side wall 20 is described in detail herein, it being understood that the side wall 22 is formed with the identical structure and functions in the same manner. The side wall 20 includes a substantially vertically oriented curb reveal 26 which extends from the bottom wall 14 to a horizontally extending ledge or step 28 best shown in FIG. 2. The horizontal extent of the step 28 is preferably on the order of about 1½ inches measured in the direction from the outer edge of curb reveal 26 toward the hollow interior 24 of barrier unit 10.

Extending upwardly at an acute angle from the step 28 is an intermediate section 30 which terminates at a vertically extending upper section 32. The upper section 32, in turn, extends from the intermediate section 30 to the top wall 12 of barrier 10 which is formed with a pair of fill holes 33 preferably having a diameter in the range of about 3-4 inches. In the presently preferred embodiment, a number of stabilizers 34 are integrally formed in the intermediate section 30, at regularly spaced intervals between the end walls 16, 18. Each stabilizer 34 includes a base 36 and opposed sides 38 and 40. The base 36 of each stabilizer 34 is coplanar with the step 28 and is supported by an internally located support 42 shown in phantom lines in FIG. 4. The sides 38, 40 of each stabilizer 34 taper inwardly, toward one another, from the base 36 to a point substantially coincident with the uppermost edge of intermediate section 30 where the upper section 32 of side wall 20 begins. In the presently preferred embodiment, a through bore 44 extends from the base 36 of one or more of the stabilizers 34, through the internal support 42 and out the bottom wall 14 of barrier 10. Each of these through bores 44 mount an eyebolt 156, as described in more detail below in connection with a discussion of FIG. 16.

As best shown in FIG. 3, a post boot 50 is formed at the bottom wall 14 of barrier 10, in alignment with each fill hole 33, to receive and support the bottom portion of a second eyebolt 160 which is inserted through the fill hole 33 as described in more detail below in connection with a discussion of FIGS. 16 and 17. The top wall 12 is also formed with an internally extending seat 74 adapted to mount a warning light 230 which preferably flashes on and off to alert vessels of the presence of the barrier units 10.

Each end wall 16 of barriers 10 is formed with an internally extending recess 48 near the bottom wall 14, which receives an outwardly protruding extension 52 formed on the end wall 18 of an adjacent barrier 10. The upper portion of end wall 16 is formed with a slot 56, and the upper portion of end wall 18 is formed with a slot 58. Each slot 56, 58 has an inner, generally cylindrical-shaped portion 59 and a narrower, substantially rectangular-shaped portion 61 at their respective end walls 16, 18. The slots 56, 58 extend from the top wall 12 downwardly to a point near the juncture of the upper section 32 and intermediate section 30.

Each barrier 10 is provided with structure on its end walls 16 and 18 for connection to an adjacent barrier 10'. For purposes of the present discussion, the same reference numbers with the addition of a "'" are used to describe the same elements of adjacent barriers. With reference to FIGS. 3, 16 and 17, when two barrier units 10 and 10' are oriented end-to-end, with the end wall 16 of one barrier 10 abutting the end wall 18' of an adjacent barrier 10', the slots 56, 58 collectively form a barbell-shaped locking channel 60 depicted in phantom in FIG. 3. This locking channel 60 receives a coupler 62 having cylindrical ends 64, 66 and a rectangular center section 67, which is removably inserted within the locking channel 60 and extends substantially along its entire length. The cylindrical ends 64, 66 of coupler 62 pivot within the correspondingly shaped cylindrical portions 59, 59' of slots 56, 58', so that one barrier unit 10 can be pivoted with respect to an adjacent barrier 10'. Further details and discussion on the structure for connecting adjacent barriers 10 to one another is provided below with reference to an additional description of FIGS. 16 and 17.

Each of the barrier units 10 further include a pair of hollow channels 68 and 70 which are located within the hollow interior 24 of barrier unit 10 and extend between the side walls 20, 22. A portion of each channel 68, 70 is positioned in the intermediate section 30 of the side walls 20, 22, in the spaces between the three stabilizers 34, and extends partially into the upper sections 32 thereof. The two channels 68, 70 provide added internal support to the barrier 10 so that it retains its shape when filled with a ballast material. Each of the channels 68 and 70 define a pass-through hole or opening 72 adapted to receive the tines of a forklift truck to permit handling of the barriers 10.

Flotation of Barrier Units

Figure 5:
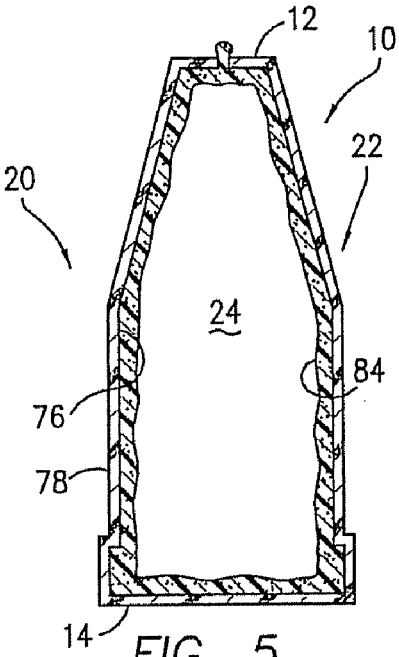
FIG. 5 is a cross sectional view taken generally along line 5-5 of FIG. 4.

As noted above, the barrier units of this invention are intended for use in marine applications to provide enhanced security for vessels when docked at port and other assets. It has been found that as a result of the molding process which forms the barrier units 10, as well as during handling, installation and use of same, cracks or other surface irregularities in the plastic forming the barrier units 10 can result in leakage of water into the hollow interior 24. With reference to FIG. 5, in one preferred embodiment of this invention structure is provided to allow the barrier units 10 to float by resisting leakage of water into the hollow interior 24 and by providing enhanced buoyancy of the barrier units 10. Each of the walls 12, 14, 16, 18, 20 and 22 of a barrier unit 10 is formed with an inner surface 76 located within the hollow interior 24 and an exterior, outer surface 78. These inner surfaces 76 receive a foam layer 84 having a thickness in the range of about 0.5 to 6 inches. The remainder of the hollow interior 24 is empty. The foam layer 84 is effective to seal the inner surface 76 of each wall 12-22 and substantially prevent leakage of water into the hollow interior 24. Additionally, the foam layer 84 is puncture resistant, particularly as its thickness is increased, and therefore resists leakage even if the plastic walls of the barrier are damaged during installation or use.

The method of forming the barrier unit 10 with the foam layer 84 forms no part of this invention, and is therefore not discussed in detail herein. Generally, a rotational molding process is employed in which a polyethylene resin and polyethylene foaming pellets are combined in a mold to form the completed barrier. Each of the walls 12, 14, 16, 18, 20 and 22 is formed of a high density polyethylene using this molding technique, preferably having a thickness on the order of about 0.25 inches. Polyethylene Resins suitable for forming the plastic walls of the barrier 10 are commercially available from ExxonMobil Chemical under the trademark "PAXON," Type Numbers 7004 and 7204 rotational molding resins.

One foam material which can be employed in the rotational molding process noted above to form the foam layer 84 is commercially available from Equistar Chemicals, Inc. of Houston, Tex. under the trademark "PETROTHENE." A structural foam, semi-rigid foam or flexible PETROTHENE foam may be employed in the barrier 10 of this embodiment of the present invention, whose properties and type numbers are as follows:

| Property | Nominal Value | Units |
|---|---|---|
| MSTR005-Structural Foam | | |
| Density | 7 | $lb/ft^3$ |
| Compressive Modulus | 800 | psi |
| Shrinkage (w/MSTR003, 4 skin) | 0.010-0.015 | in/in |
| Thermal Conductivity (k) | 0.435 | BTU in/hr $ft^2$ ° F. |
| MSTR008-Semi-Rigid Foam | | |
| Density | 4 | $lb/ft^3$ |
| Compressive Modulus | 180 | psi |
| Shrinkage (w/MSTR003, 4 skin) | 0.010-0.015 | in/in |
| Thermal Conductivity (k) | 0.384 | BTU in/hr $ft^2$ ° F. |
| MSTR007-Flexible Foam | | |
| Density | 2 | $lb/ft^3$ |
| Compressive Modulus | 35 | psi |
| Shrinkage (w/MSTR003, 4 skin) | 0.010-0.015 | in/in |
| Thermal Conductivity (k) | 0.357 | BTU in/hr $ft^2$ ° F. |

In most instances it is contemplated that a semi-rigid foam would be employed to form the foam layer 84, such as PETROTHENE Type No. MSTR008. If additional structural rigidity is required, a denser foam with increased compressive modulus may be used such as PETROTHENE Type No. MSTR005. Further, the overall thickness of the foam layer 84 can be controlled in the molding process to increase or decrease the rigidity of the barrier 10, i.e., the thicker the foam layer 84 the more rigid the walls 12-22.

Figure 6:
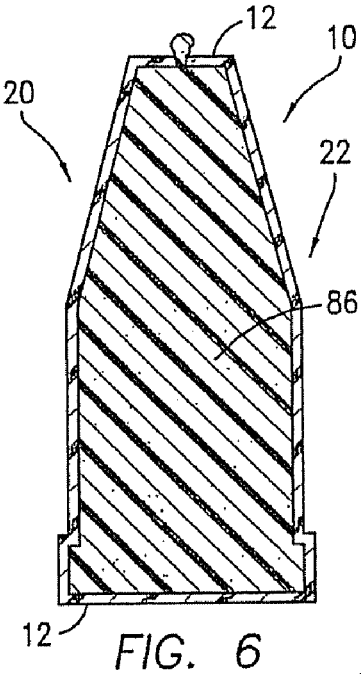
FIG. 6 is a cross sectional view similar to FIG. 5 except of an alternative embodiment in which the barrier unit is completely filled with a foam material.

Referring now to FIG. 6, a further embodiment of this invention is shown in which the hollow interior 24 of the barrier 10 is completely filled with a foam material to form a solid foam body 86. One presently preferred foaming material is a two-component polyether-based, low density pour-in-place urethane foam commercially available from North Carolina Foam Industries of Mount Airy, N.C. under the name "NCFI Low Density Pour System 31-120." The resin properties and reaction properties of this material are as follows:

| | 31-120R | 31-120A |
|---|---|---|
| TYPICAL RESIN PROPERTIES: | | |
| Viscosity @ 72° F. | 500 cps | 200 cps |
| Weight Per Gallon | 9.5 lbs. | 10.2 lbs. |
| Appearance | amber liquid | brown liquid |
| Shelf Life | 6 months | 6 months |
| MIX RATIO: | | |
| Ratio By Weight | 100 parts | 107 parts |
| Ratio By Volume | 100 parts | 100 parts |

| | Hand Mix @ 72° F. |
|---|---|
| TYPICAL REACTION PROPERTIES: | |
| Cream Time, seconds | 32 |
| Gel Time, seconds | 140 |
| Rise Time, seconds | 210 |
| Density (FRC) | 1.9 pcf |

Preferably, such foam material is introduced in liquid form into the hollow interior 24 of a barrier unit 10 through one of the fill holes 33, and then allowed to cure in situ thus filling up the entire volume of the hollow interior 24. Not only is the buoyancy of the barrier units 10 enhanced by a continuous body of foam material 86, but the structural integrity thereof is improved since cracks, punctures or other damage to the outer, plastic skin of the barrier units 10 would not affect the ability of same to remain afloat in the water. As noted above, the empty weight of a barrier unit 10 is about 75 to 135 pounds, and the addition of a foam layer 84 or continuous foam body 86 adds little to the overall weight.

Figure 15:
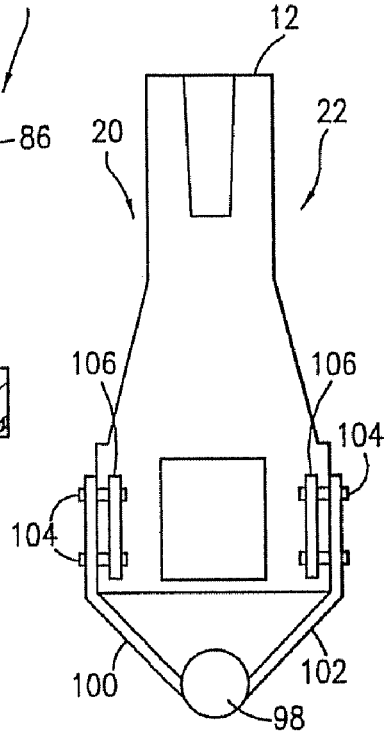
FIG. 15 is a schematic, end view of a barrier unit having a ballast weight extending below the bottom wall.
Figure 13:
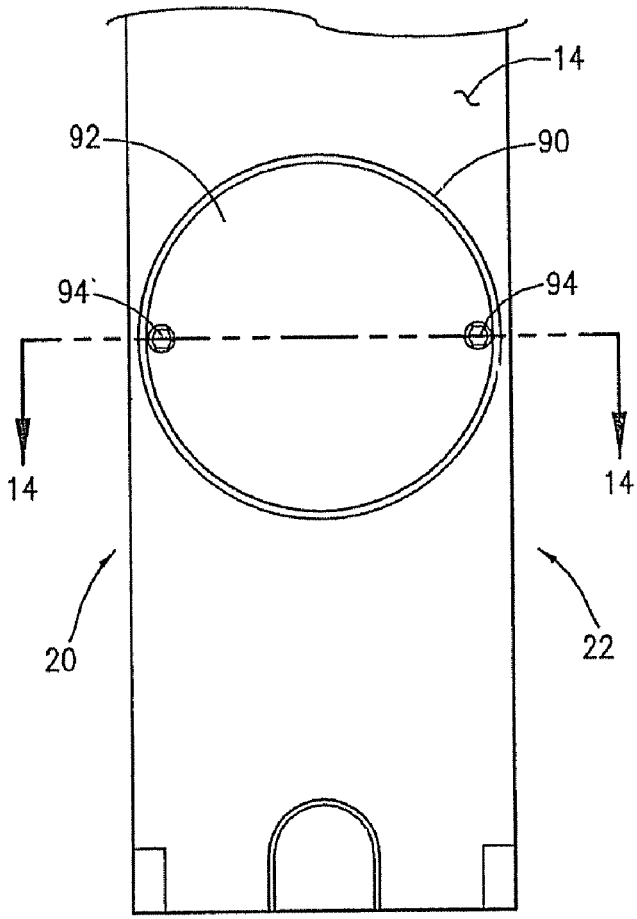
FIG. 13 is a bottom view of the barrier unit shown in FIG. 2.
Figure 14:
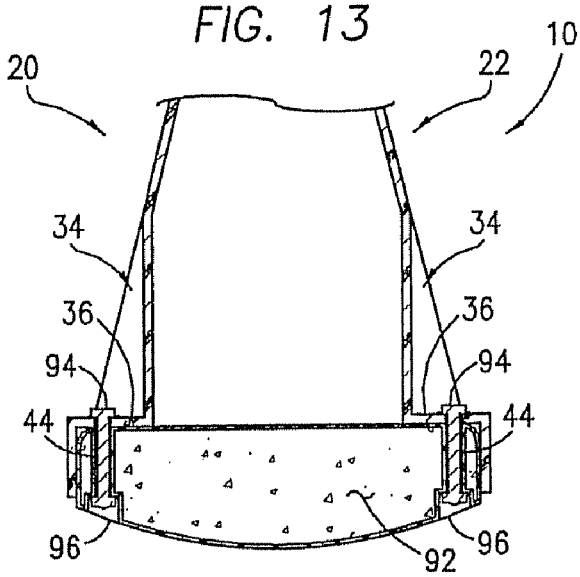
FIG. 14 is a cross sectional view taken generally along line 14-14 of FIG. 13.

Although the barrier units 10 readily float in the water, it is important that they be maintained in an upright position for maximum visibility, i.e. with the bottom wall 14 and a portion of the side walls 20, 22 submerged, and the top wall 12 out of the water. Referring now to FIGS. 13-15, alternative embodiments are illustrated of a ballast weight used to maintain the barrier units 10 in an upright position. In the embodiment of FIGS. 13 and 14, a recess 90 is formed in each barrier unit 10 which extends inwardly from the bottom wall 14 into the hollow interior 24. The recess 90 is located at the center of the barrier unit 10, immediately beneath the base 36 of the center stabilizer 34 formed in the side walls 20 and 22. A ballast weight 92 is mounted within the recess 90 by a pair of bolts or pins 94, each extending from a seat 96 formed in the ballast weight 92 though the through bore 44 formed in the base 36 of the center stabilizer 34. In this embodiment, the ballast weight 92 is substantially entirely received within the recess 90 and protrudes only slightly beyond the bottom wall 14 of the barrier unit 10. Preferably, the ballast weight 92 is formed of concrete encased with rubber or other non-abrasive material.

In an alternative embodiment depicted in FIG. 15, a ballast weight 98 is suspended below the bottom wall 14 of the barrier unit 10 by a pair of chains or cables 100 and 102. One end of each cable 100, 102 is embedded in the ballast weight 98, preferably of the same type as ballast weight 92, and the opposite end of each cable 100, 102 is mounted to the side walls 20, 22, respectively of the barrier unit 10 by any suitable fasteners 104 which connect to an internal plate 106.

Barrier Units of FIGS. 7-12

Figure 7:
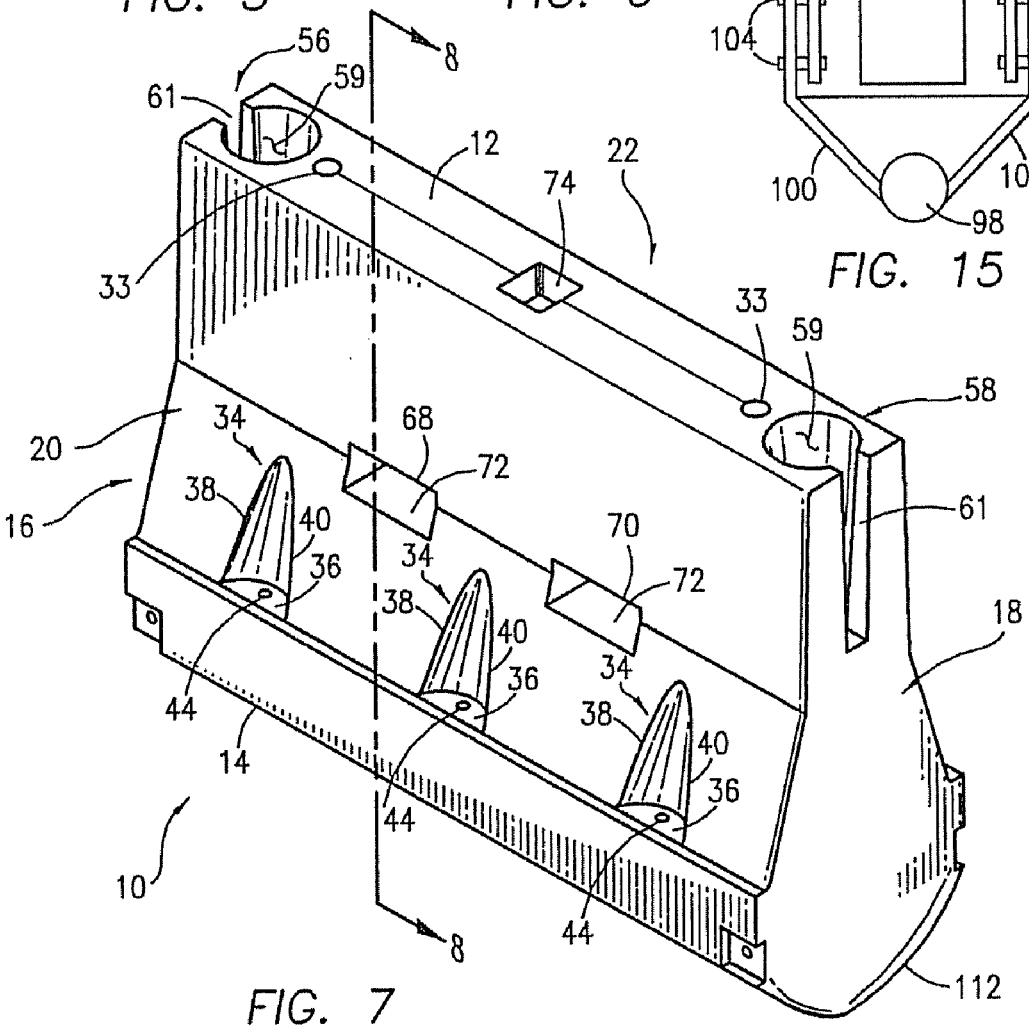
FIG. 7 is a perspective view of a barrier unit similar to that depicted in FIGS. 2-4, except with a hull-shaped bottom wall.
Figure 8:
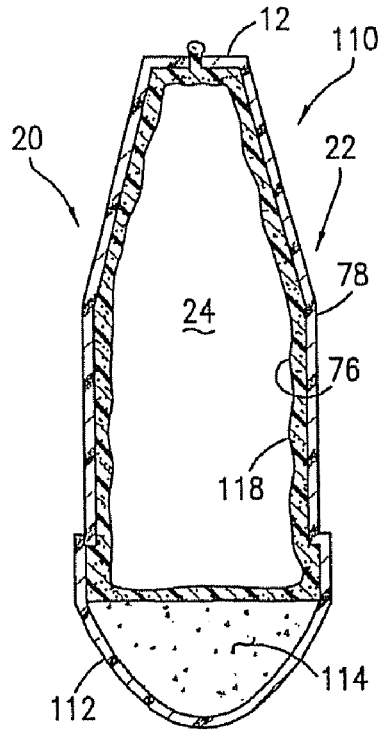
FIG. 8 is a cross sectional view taken generally along line 8-8 of FIG. 7.
Figure 9:
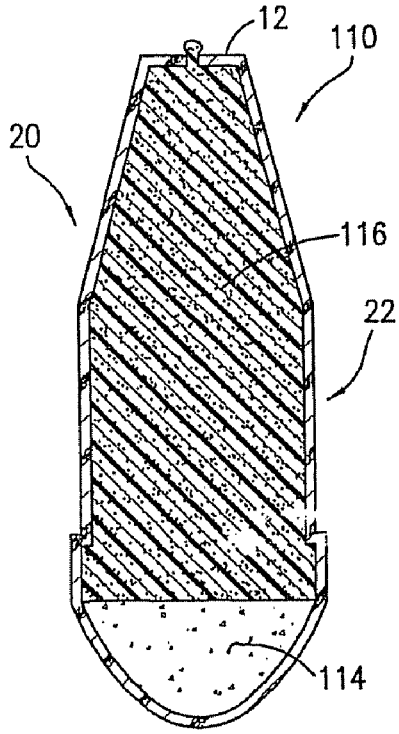
FIG. 9 is a cross sectional view similar to FIG. 9 except of an alternative embodiment in which the barrier unit is completely filled with a foam material.

Referring initially to FIGS. 7-9, an alternative embodiment of a barrier unit 110 according to this invention is shown. The barrier unit 110 is similar to the barrier unit 10, and the same reference numbers are used to indicate like structure in the devices 10 and 110. To enhance stability in the water, and further assure that the barrier unit remains in the upright position, the barrier unit 110 of this embodiment is formed with a bottom wall 112 having a shape similar to the hull of a vessel. The other walls of the barrier unit 110 have the same construction, and are formed of the same material, as the walls 12-22 of barrier unit 10 described above.

One other modification of the barrier unit 110 compared to barrier unit 10 involves the ballast weight. Instead of attaching a ballast weight on the exterior of the barrier unit 110, as in the embodiment of FIGS. 13-15, concrete, crushed stone or other heavy material is introduced into the hollow interior 24 through the fill holes 33 to form a ballast layer or weight 114 along the bottom wall 112. The ballast layer 114 may extend part way upwardly along the side walls 20, 22, if desired, to provide additional weight.

For the same reasons discussed above in connection with the barrier unit 10, it is preferred to incorporate a foam layer or core within the interior of barrier unit 110. As best seen in FIG. 9, in one embodiment a body of foam material 116 is provided which is identical to the foam body 66 discussed above in connection with FIG. 6, except that the body of foam material 116 begins at the top surface of the ballast layer 114 and fills the remainder of the volume of the hollow interior 24. Alternatively, a foam layer 118 is formed along the walls 12, 16, 18, 20, 22 and bottom wall 112, in the same manner as described above in connection with a discussion of FIG. 5, but with the ballast layer 114 filling the area along the bottom of the barrier unit 110. See FIG. 8.

Figure 10:
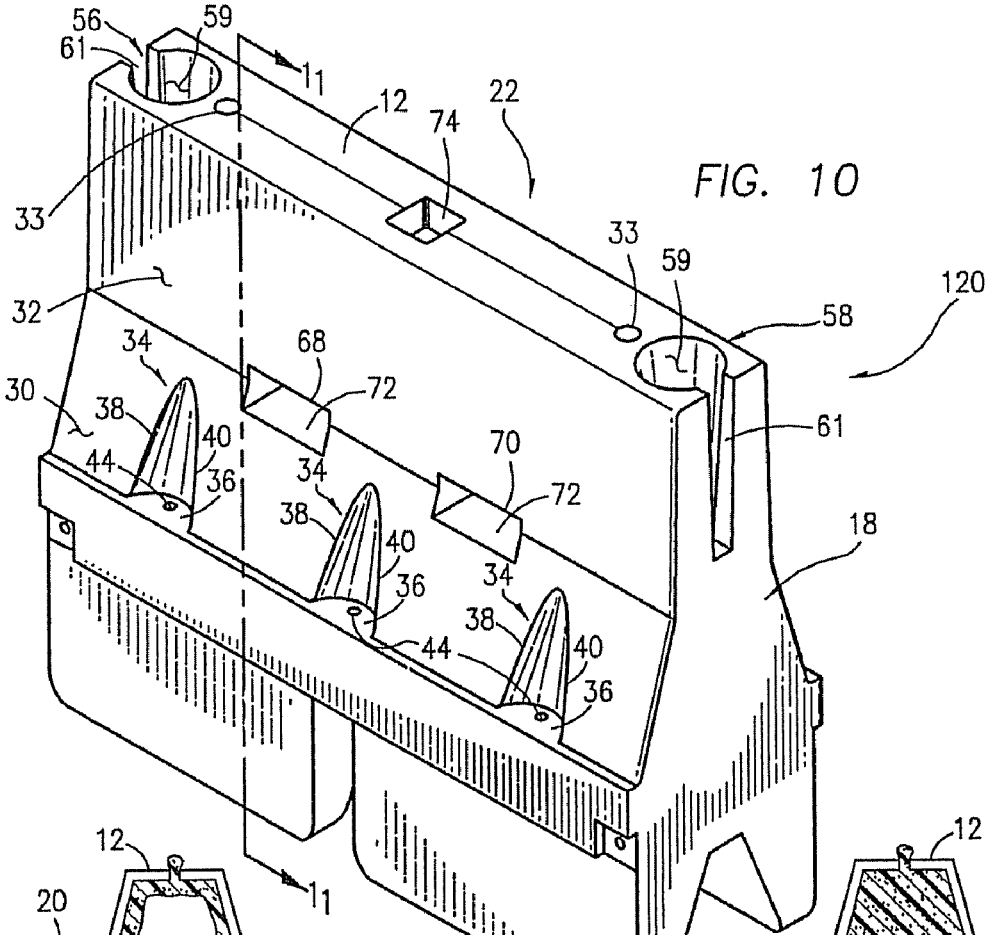
FIG. 10 is a perspective view of an alternative embodiment of a barrier device according to this invention in which the bottom wall is formed with spaced pontoons.
Figure 11:
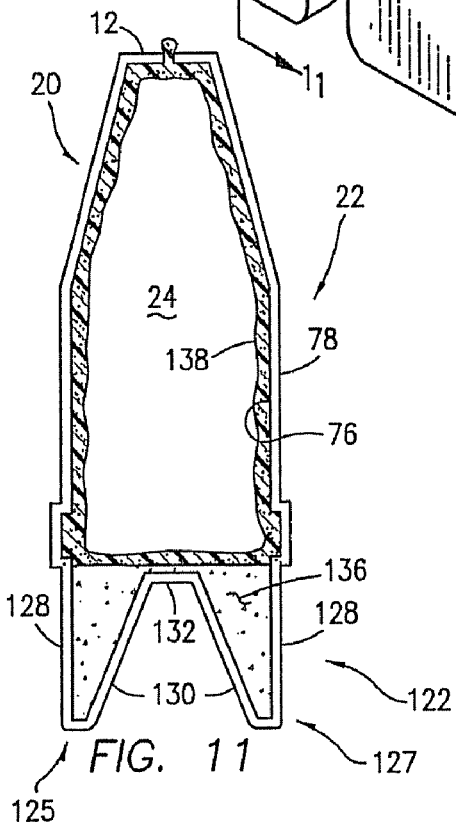
FIG. 11 is a cross sectional view taken generally along line 11-11 of FIG. 10.
Figure 12:
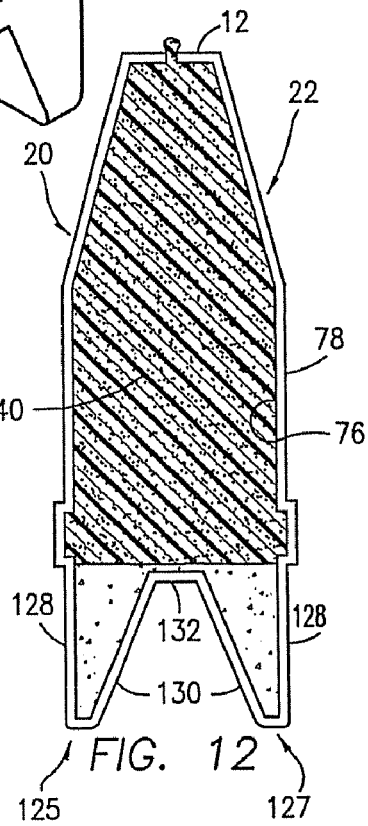
FIG. 12 is a cross sectional view similar to FIG. 11 except of an alternative embodiment in which the barrier device is completely filled with a foam material.

An alternative embodiment of a barrier unit 120 according to this invention which employs structure for stabilizing the barrier, and an internal ballast weight, is shown in FIGS. 10-12. In this embodiment, the bottom wall 122 of the barrier unit 120 is formed with a pair of spaced pontoons 124 and 125 extending downwardly from the side wall 20, and a pair of spaced, second pontoons 127 (only one of which is shown) extending from the side wall 22. As depicted in FIG. 10, the pontoons 124 and 125 are spaced from one another in a longitudinal direction, e.g., between the end walls 16, 18, as are the pontoons 127. The purpose of this separation is to reduce drag on the barrier unit 120 imposed by tides, current and other water movement. Each of the pontoons 124-127 has a generally vertical wall 128, with the barrier 120 in the position depicted in the Figs., and an angled wall 130 extending from the vertical wall 128 toward the center of the barrier unit 120. A small space 132 is formed between the angled walls 130 of the two pontoons 124, 126 at the barrier center, as shown. Preferably, each pontoon 124 and 126 has a rounded end at the juncture of the vertical and angled walls 128, 130.

The purpose of the spaced pontoons 124, 126 and 127 is to provide added stability to the barrier unit 120 in the water. The barrier unit 120 is further stabilized by, a ballast weight 136 consisting of material such as concrete, gravel, sand or the like is added within the hollow interior of each pontoon 124-127, i.e., in the space defined by the volume between the respective walls 128, 130 of the pontoons 124-127. If desired, additional ballast material can be introduced into the hollow interior 24 of the barrier unit 120 above the level of the bottom wall 122.

As shown in FIGS. 11 and 12, the barrier unit 120 of this embodiment is also preferably formed with either a foam layer or core of foam material as in the barrier unit 110 described above in connection with a discussion of FIGS. 7-9. In FIG. 11, a foam layer 138 is formed along the walls 12, 16, 18, 20 and 22 of the barrier unit 120 at a location above the ballast weight 136. Alternatively, with reference to FIG. 12, a solid foam body 140 is provided within the hollow interior 24 of barrier unit 120 overlying the ballast weight 136, which is essentially identical to the body of foam material 116 depicted in FIG. 9.

Connection of FIGS. 2-12 Barriers

Another aspect of this invention involves the connection of adjacent barrier units 10 together to form a barrier wall 150 as schematically depicted in FIG. 1. Such connecting structure includes, in alternative embodiments, means for mounting the barrier units 10 together at their opposed ends, and means for supporting a cable, rope, chain or other substantially continuous elongated connector along each the barrier units 10 when oriented end-to-end. Two barrier units 10 and 10' are depicted in FIGS. 3, 16 and 17, which are identical in structure and function. The same reference numbers are therefore used to identify like structure, with the addition of a "'" to the numbers associated with barrier 10'.

As noted above, when two barrier units 10 and 10' are oriented end-to-end, with the end wall 18 of one barrier 10 abutting the end wall 16' of an adjacent barrier 10', the slots 56, 58 collectively form a barbell-shaped locking channel 60. See also FIG. 4. A coupler 62 is inserted within the locking channel 60 to pivotally interconnect the adjacent barrier 10, 10'. In each of the embodiments of FIGS. 16 and 17, a horizontally oriented strap 152 is extended through the opening 72 of barrier 10 and through the opening 72' of the adjacent barrier 10'. This strap 152 provides additional end-to-end support to resist disengagement of the barriers 10, 10'. The horizontal strap 152 also connects to a vertically extending strap 154 which is looped over the coupler 62 inserted within the locking channel 60. One end of the vertical strap 154 is connected to the horizontal strap 152 along the side walls 22, 22' of the barrier units 10, 10', and the opposite end of vertical strap 154 mounts to the horizontal strap 152 on the opposite side walls 20, 20' of barrier units 10, 10' (not shown). The purpose of the vertical strap 154 is to maintain the coupler 62 in place within the locking channel 60.

Figure 16:
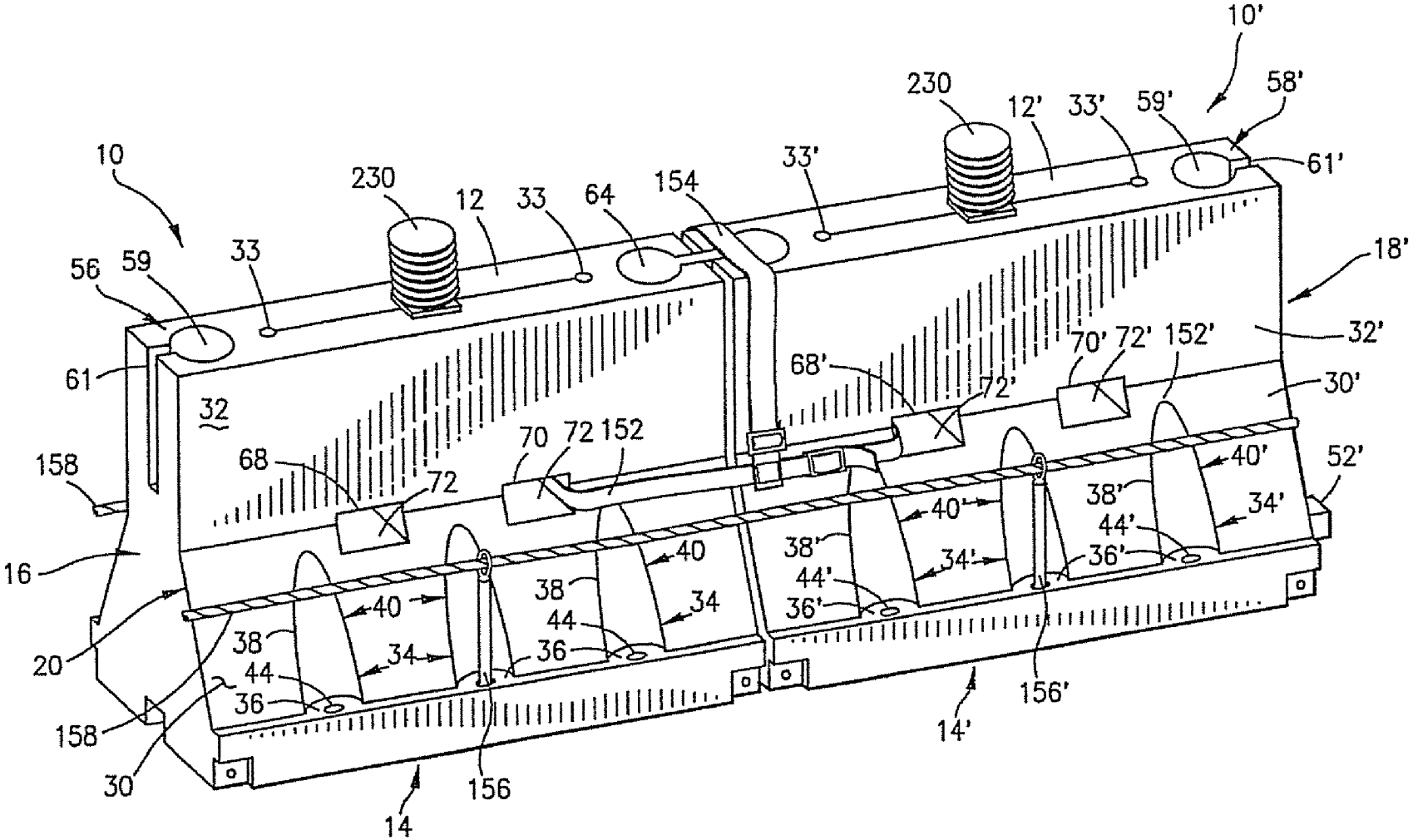
FIG. 16 is a view of two barrier units connected end-to-end carrying a cable with eyebolts mounted at the curb reveal of the barrier devices.
Figure 17:
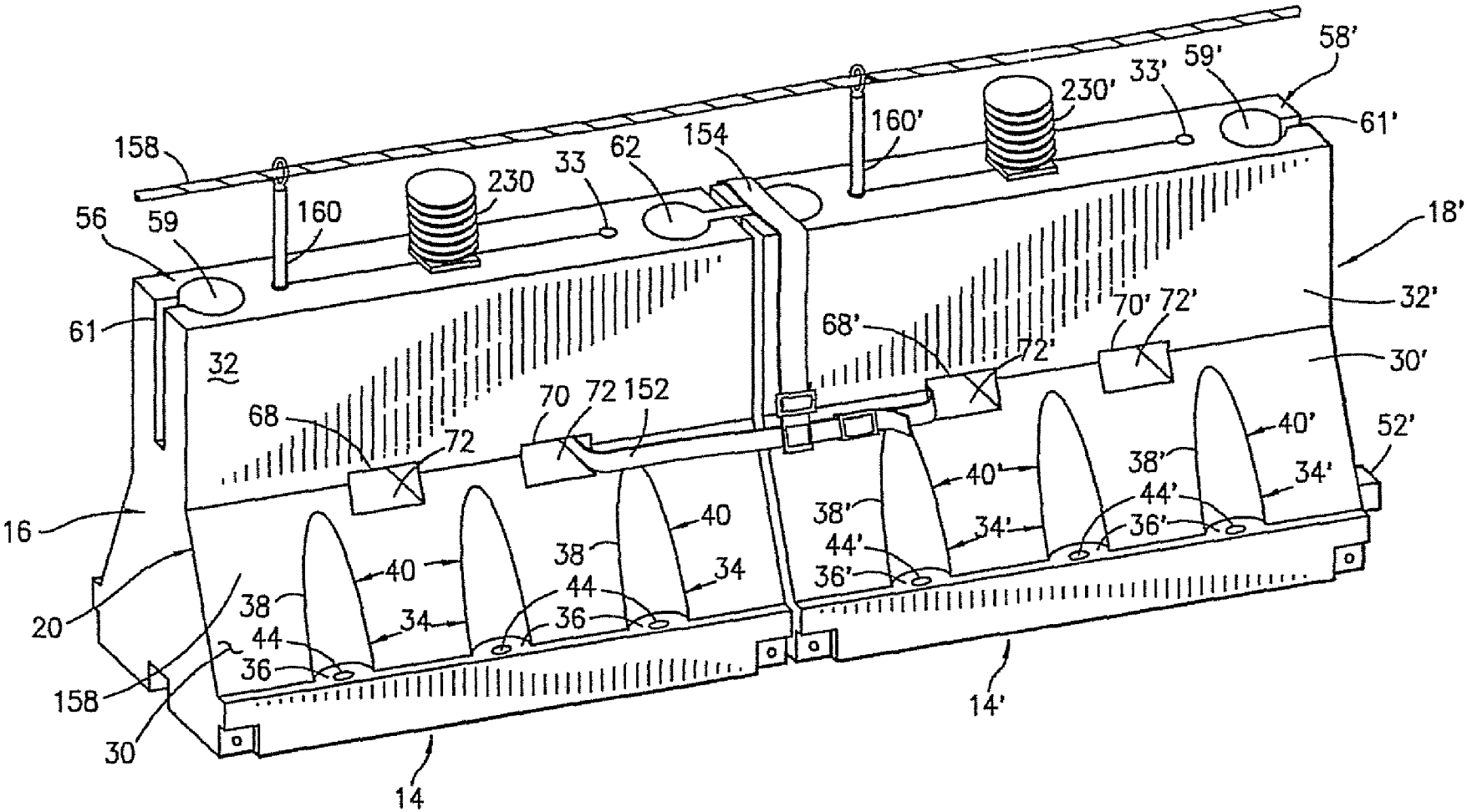
FIG. 17 is a view similar to FIG. 16 except with the cable carried by eyebolts mounted at the top wall of the barrier devices.

In the embodiments of FIGS. 16 and 17, additional structure is provided to interconnect adjacent barrier units 10, 10', and to form the barrier wall 150. Referring initially to FIG. 16, at least one eyebolt 156 is extended though a through bore 44 in the barrier unit 10, and an eyebolt 156' is carried by a through bore 44' in barrier device 10'. The eyebolts 156, 156' are secured to the barrier 10, 10' by a nut (not shown). A cable, chain, rope or other elongated member 158 is extended through the eye of the eyebolts 156, 156' and, preferably, is mounted at opposite ends to a permanent structure such as a pier 157, dock other permanent structure as schematically depicted in FIG. 1. The eyebolts 156, 156' are effective to maintain the elongated member 158 out of the water in a position to engage the hull, or at least the screw, of an oncoming vessel. It is contemplated that if such construction does not stop a vessel, the elongated member 158 will impede it's progress sufficiently to allow time for defensive action by vessels in the port.

Referring now to FIG. 17, an alternative means of mounting the elongated member 158 is shown. In this embodiment, eyebolts 160 and 160' are mounted within one of the fill holes 33, 33' of respective barrier devices 10, 10', with the end of the eyebolts 160, 160' being secured in the post boot 50, 50' with any suitable fastener (not shown). See also FIG. 3. The eye of each eyebolt 160, 160' receives and supports the elongated member 158 in position above the top wall 12 of the barrier units 10, 10' for the same purposes as described above in reference to a discussion of FIG. 16. The barriers 10, 10' are otherwise identical to those illustrated in FIG. 16.

It should be understood that while the structure noted above for interconnecting adjacent barriers has been described with reference to barrier units 10 and 10', adjacent barrier units 110, 110' and 120, 120' are interconnected in the same fashion.

Figure 18:
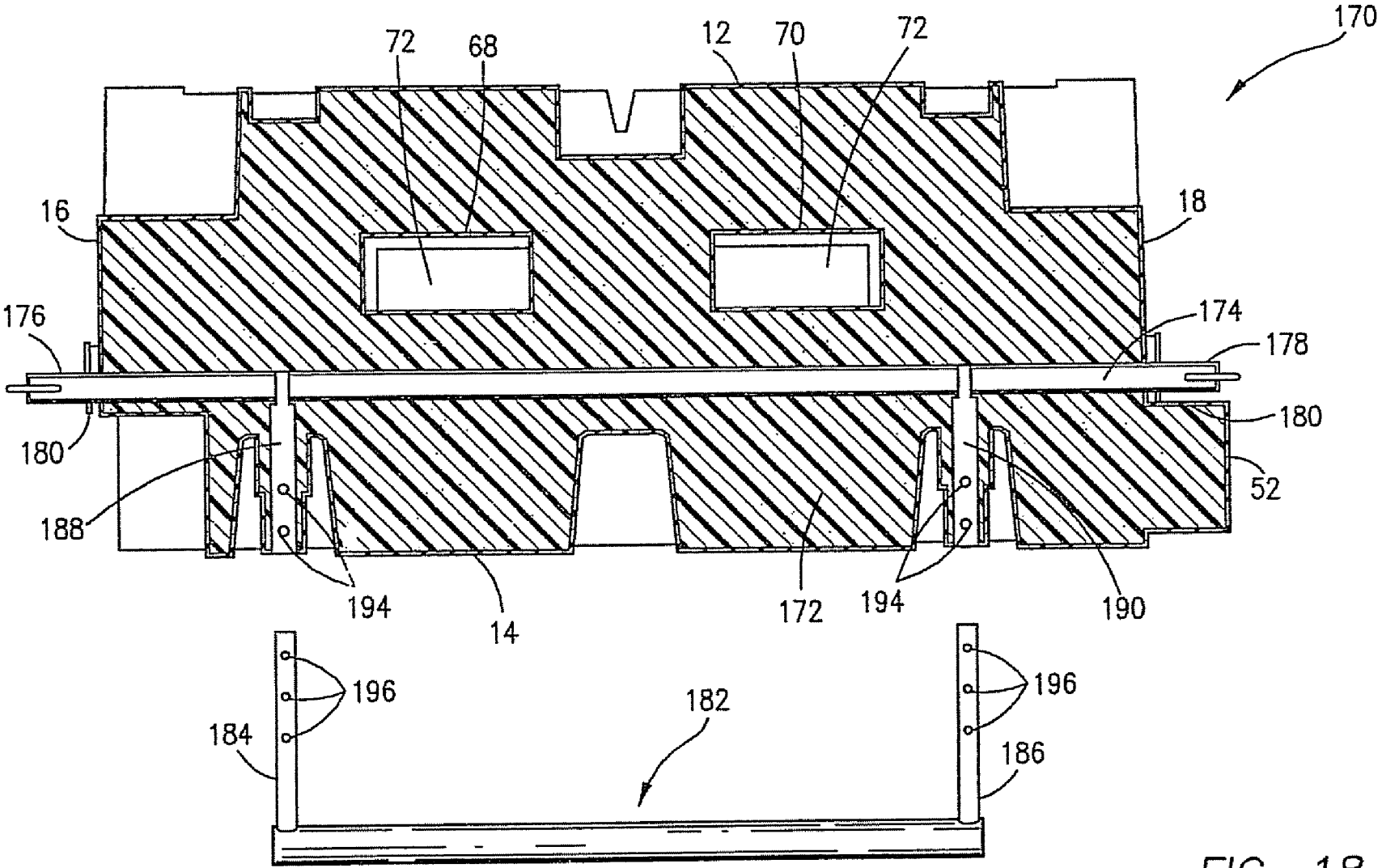
FIG. 18 is a cross sectional, elevational view of an alternative embodiment of a barrier unit incorporating an adjustable height ballast weight.
Figure 19:
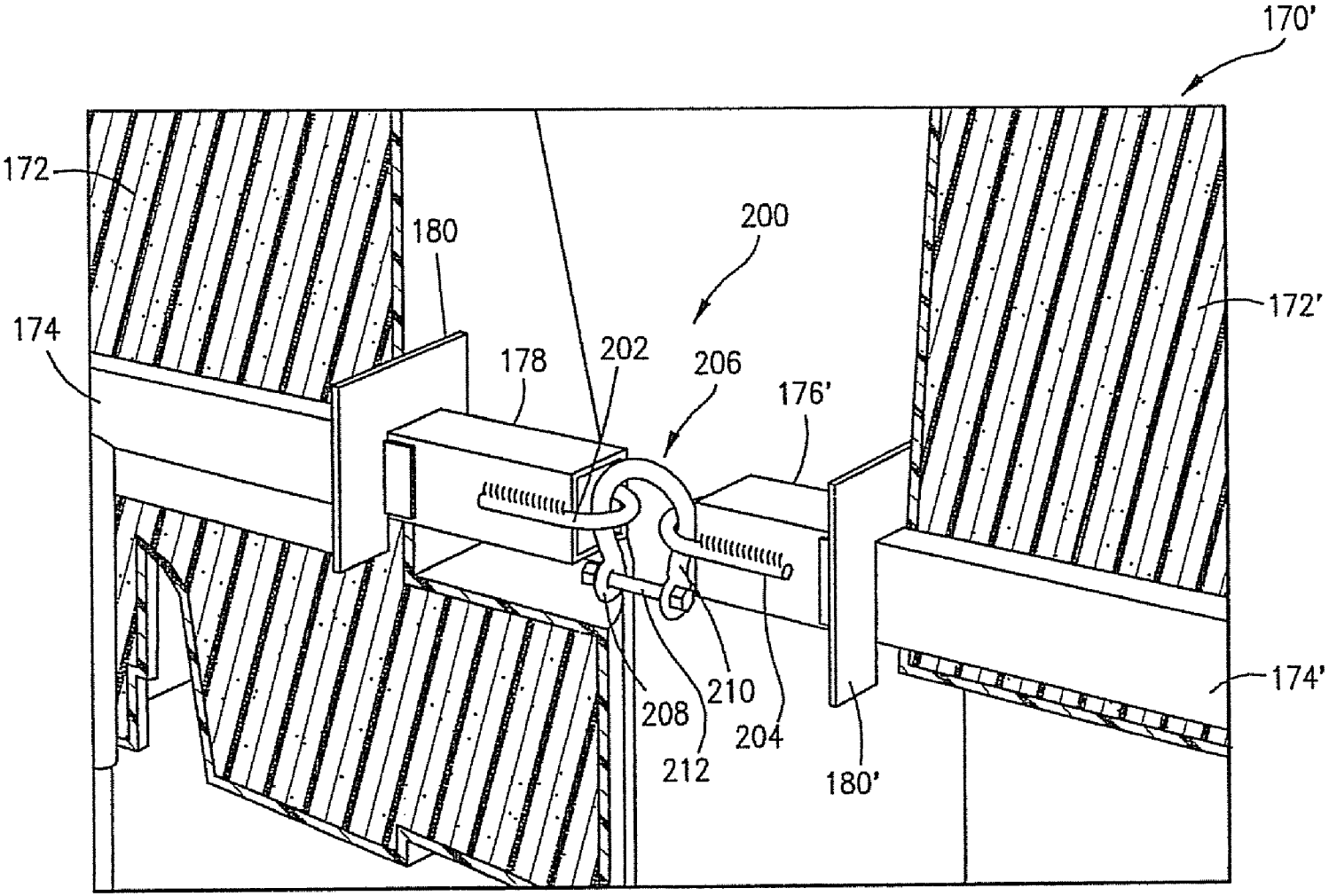
FIG. 19 is a view of the mounting structure for connecting two barriers of the type illustrated in FIG. 18 end-to-end.

Barrier Unit of FIGS. 18 and 19

Referring now to FIGS. 18 and 19, a still further embodiment of a barrier unit 170 is illustrated which is similar in construction to the barrier unit 10 except primarily for the ballast weight and means for connecting adjacent barriers together. Structural elements of the barrier unit 170 which are common to that of barrier unit 10 are given the same reference numbers in FIGS. 18 and 19.

In the presently preferred embodiment, the entire hollow interior of barrier unit 170 is filled with a foam material body 172 comprised of the same foam as described above in connection with a discussion of a previous embodiment herein. A pipe 174, or other hollow member, extends through the interior of the barrier unit 170 at a location above the extension 52. One end 176 of the pipe 174 protrudes from the end wall 16, and its opposite end 178 protrudes from the end wall 18. A retention plate 180 is mounted to each end 176, 178 of the pipe 174 at the point where they extend through end walls 16, 18, respectively. The retention plate 180 assists in retaining the pipe 174 in position within the barrier interior 24.

An elongated ballast weight 182 is suspended beneath the bottom wall 14 of barrier unit 170 by a pair of mounting arms 184 and 186. Each of the mounting arms 184, 186 is telescopically received within a sleeve 188, 190, respectively, connected to the pipe 174. The sleeves 188, 190 extend from the bottom wall 14 of the barrier unit 170 into the barrier interior, and are mounted to the pipe 174 by a collar 192 or other suitable fastener. As shown in FIG. 18, spaced holes 194 are formed in each of the sleeves 188, 190 which correspond to spaced openings 196 formed in the mounting arms 184, 186. One of the openings 196 in the mounting arms 184, 186 is aligned with a hole 194 in the sleeves 188, 190 to receive a pin or key (not shown) in order to connect the two together. The provision of a number of spaced holes 194 permits vertical adjustment of the position of the ballast weight 182 relative to the bottom wall 14 of the barrier unit 170, as desired. It is contemplated that a warning light (not shown) or other equipment could be mounted to the seat 74 and other locations along the top wall 12 of the barrier unit 170. The greater the quantity, weight and height of such equipment, the greater the tendency of the barrier unit 170 to tip over on its side or upside down. This tendency is resisted by the ballast weight 182, and its position is adjusted downwardly with respect to the bottom wall 14 of the barrier unit 170 to increase its effectiveness as a counterweight. Furthermore, the overall mass of the ballast weight 182 can be increased, if necessary, to ensure the barrier unit 170 remains in an upright position.

The ballast weight 182 is preferably a tube, pipe or other hollow member which is filled with concrete, gravel or other heavy material. In addition to stabilizing the barrier unit 170, the shape and location of the ballast weight 182 resists the effects of current, tides and other water movement. This aids in stabilizing the barrier unit 170 in the water, and reduces stress on the coupling elements which interconnect adjacent barriers 170, 170'. It is contemplated that the ballast weight 182, and/or its mounting arms 184, 186, could be utilized to mount a variety of equipment such as listening devices, motion sensors, explosive devices, netting and the like (not shown) below the surface of the water.

Referring now to FIG. 19, portions of two barrier units 170 and 170' are shown with the coupling element 200 which interconnects them. In the presently preferred embodiment, a U-shaped bracket 202 is welded or otherwise permanently affixed to the end 178 of the pipe 174 carried by the barrier unit 170, and a second bracket 204 is connected in the same manner to the end 176' of the pipe 174' of the barrier unit 170'. As depicted FIG. 19, a portion of each bracket 202, 204 protrudes from respective ends 178 and 176' of the barrier units 170, 170' in position to receive and mount a shackle 206. One arm 208 of the shackle 204 extends into the bracket 202 and its other arm 210 is received within the bracket 204. The arms 208, 210 are connected by a bolt 212 as shown. The coupling arrangement for the barrier units 170, 170' provides a secure connection, and the curved portion of the U-shaped brackets 202, 204 to which the shackle 204 is connected allow for at least limited pivotal motion of one barrier unit 170; 170' relative to the other.

In forming the barrier wall 150, whether employing the barrier units 10, 110, 120 or 170, it is preferred to include a series of platforms 220 at selected intervals each carrying two or more barrier units. For purposes of the present discussion, and with reference to FIG. 20, a platform 220 is shown with three barrier units 10, 10 and 170 in a side-by-side position to be received by the platform 220. The platform 220 has four interconnected sides 222, 224, 226 and 228, and a pair of cross braces 230 and 232. The cross braces 230 and 232 are mounted to the bottom of the two opposed sides 222, 226 and are spaced from one another a distance somewhat less than the length of the barrier units 10, 10 and 170, as measured between their end walls 16, 18. Each of the cross braces 230 and 232 mounts upright posts 234 which are positioned to be inserted within the through bores 44 on opposite sides of each barrier 10, 10 and 170, and then connected thereto by nuts 236, when the barriers 10, 10 and 170 are placed within the platform 220 atop the cross braces 220.

Figure 20:
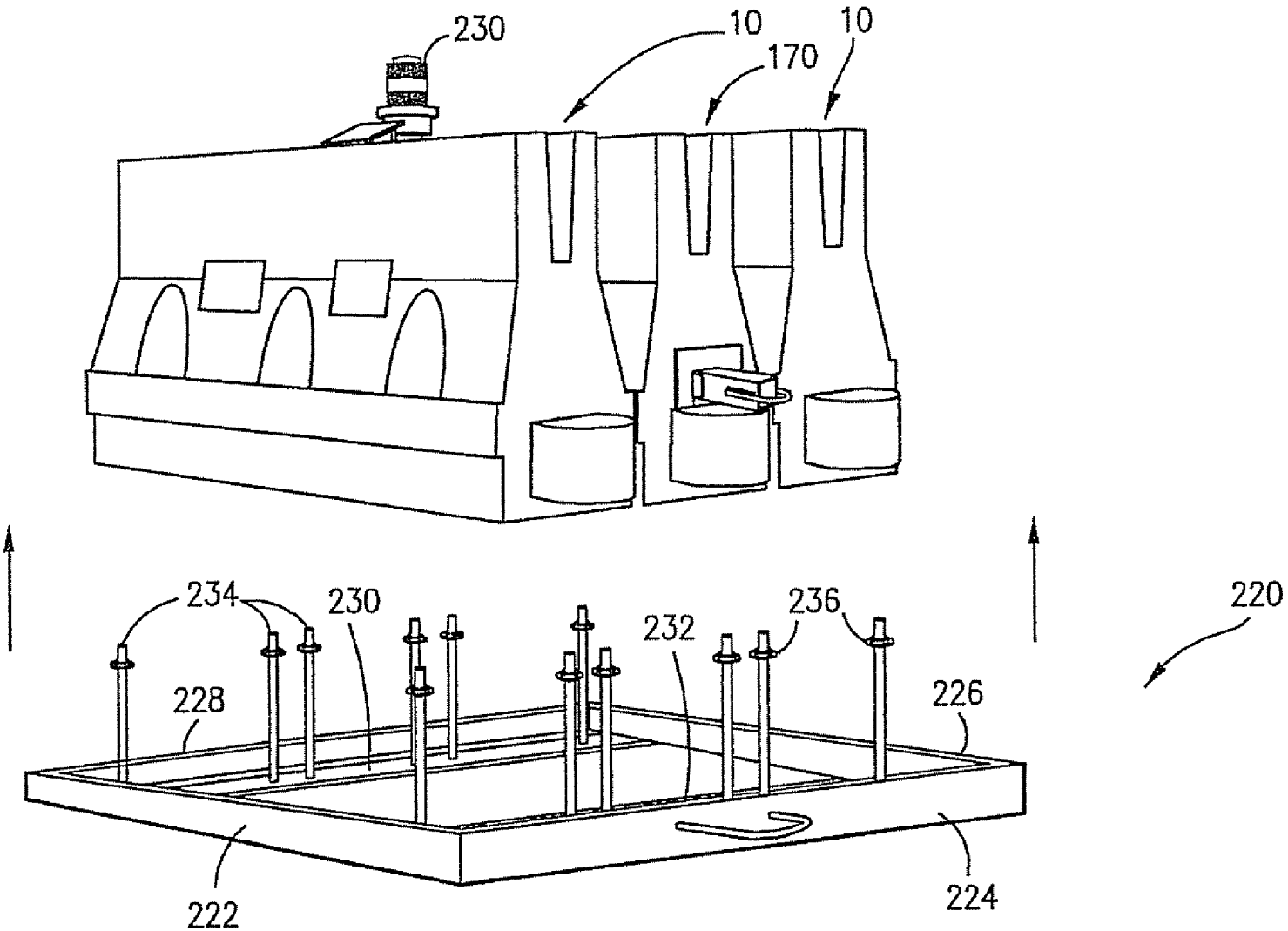
FIG. 20 is a disassembled, perspective view of a platform designed to receive and support three barrier units of the type shown in FIGS. 18 and 19.

One purpose of the platform 220 is to add overall stability to the barrier wall 150. As noted above, a number of platforms 220 are located at spaced intervals along the length of the barrier wall 150, and with three side-by-side barriers 10, 10 and 170 within each platform 220 increased resistance is provided to overturning of individual barriers 170. Additionally, as schematically depicted in FIG. 20, a warning light 230 can be mounted to one or more of the barrier units 10, 10 or 170 on the platforms 220 to increase visibility of the entire barrier wall 150. Preferably, the coupling element 200 associated with barrier unit 170 carried by the platform 220 is used to connect opposite ends of the platform 220 to adjacent barriers 170 in the barrier wall 150.

Barrier Unit of FIGS. 21-25

Referring now to FIGS. 21-25, a still further embodiment of a barrier unit 300 is illustrated. The barrier unit 300 has a top wall 302, a flat bottom wall 304, opposed end walls 306 and 308, and, opposed side walls (not shown) which are interconnected to form a housing 310 having a hollow interior 312. The material which forms the housing 310 is the same as that described above in connection with a discussion of the barrier unit 10, and will not be repeated here.

Preferably, the entire hollow interior 312 of barrier unit 300 is filled with a foam material body 314 comprised of the same foam as described above in connection with a discussion of the other embodiments of this invention. A reinforcement member in the form of a C-shaped channel 316 extends through the interior 312 of the barrier unit 300 from one end wall 306 to the other end wall 308, and beneath fork lift openings 318 and 320 extending between the side walls of the housing 310. One end 322 of the channel 316 protrudes from the end wall 306, and its opposite end 324 extends from the end wall 308. These ends 322 and 324 carry couplers used to mount adjacent barrier units 300 end-to-end, as described below in connection with a discussion of FIGS. 23, 24 and 25.

As applications for the barrier units of this invention have expanded, it has be found desirable to treat individual barrier units, and a barrier wall formed of a number of units mounted end-to-end, as a "platform" for mounting a variety of accessory items 327 such as signs, lights, fencing, nets, motion detectors, radiation detectors, radar or sonar equipment, depth finders and even weapons or explosives. To that end, the barrier units 300 of this embodiment are each provided with a pair of mounting posts 326 and 328, and structure for securing them in place. The mounting posts 326, 328 are hollow tubes made of galvanized steel or other corrosive resistant material.

Figure 21:
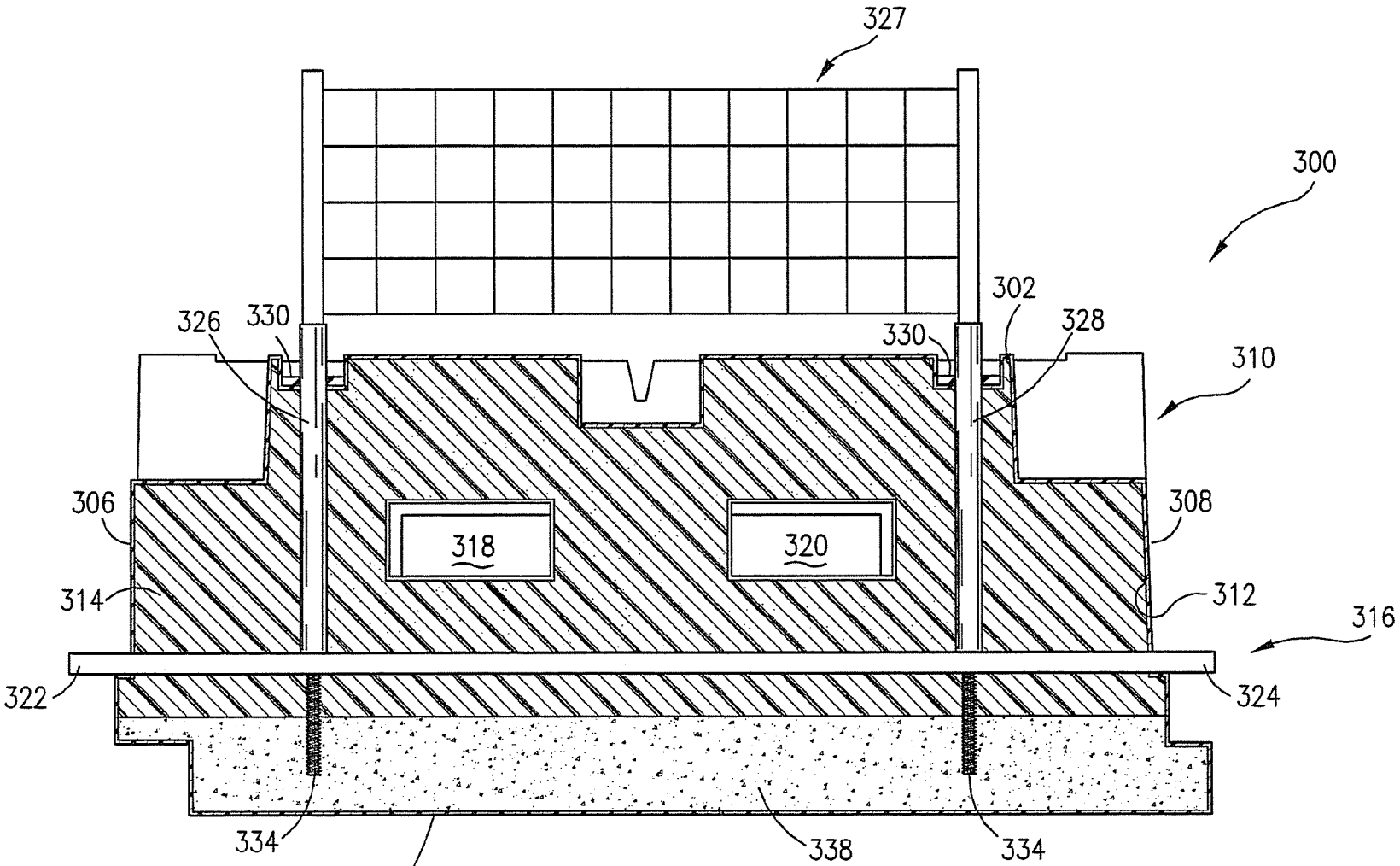
FIG. 21 is an elevational view, in cross section, of a further embodiment of a barrier unit according to this invention having an internal reinforcement member secured to a pair of mounting posts by two connectors.
Figure 22:
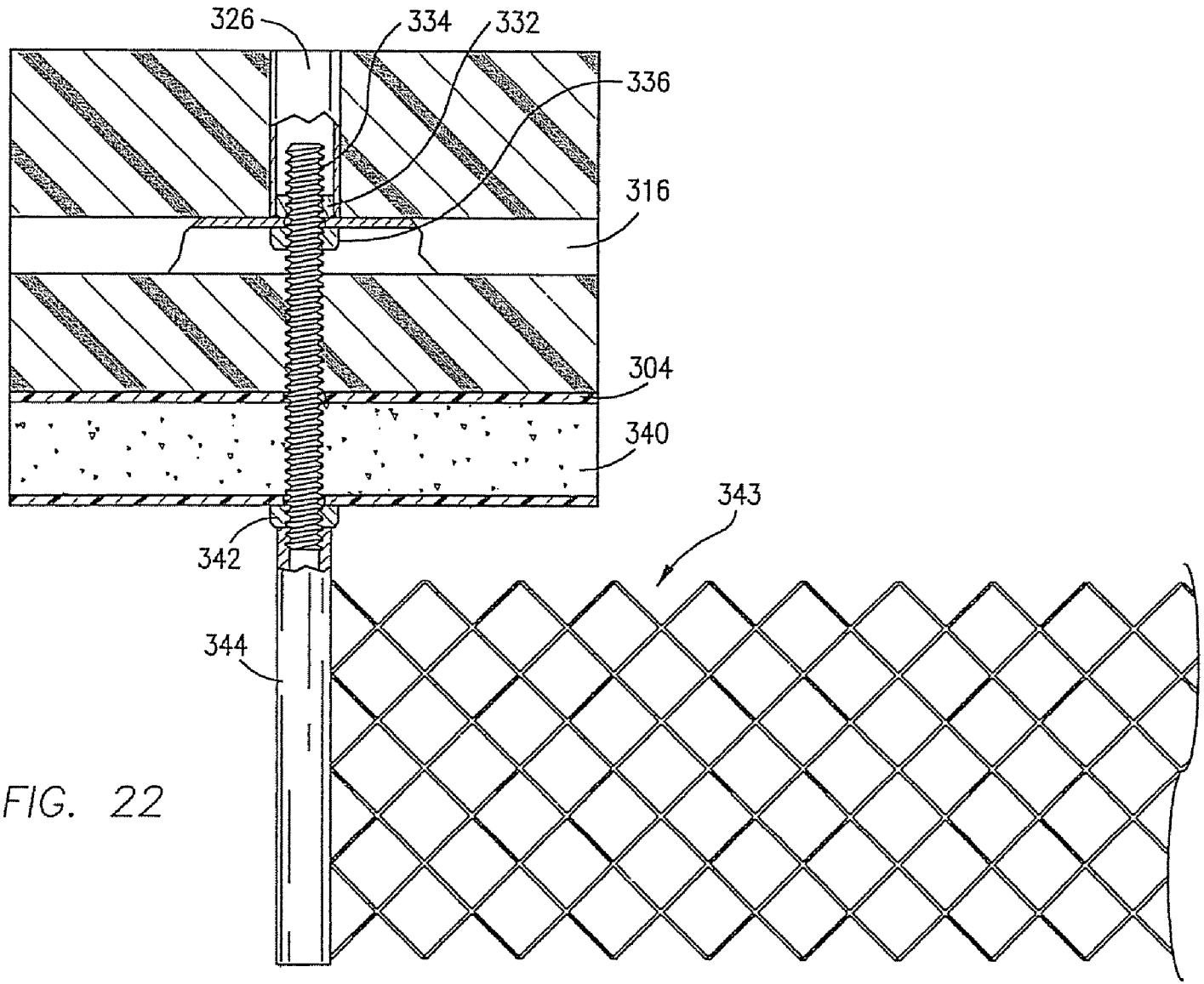
FIG. 22 is an enlarged view, in cross section, of the connection between the reinforcement member, mounting posts and connector of FIG. 21 wherein the ballast weight is mounted externally of the barrier unit by the connectors, and the bottom end of the connectors mount an accessory.

Referring to FIGS. 21 and 22, two openings are formed in the top wall 302 of barrier unit 300 each of which receive a rubber bushing 330. An inner portion of each mounting post 326, 328 extends through a bushing 330, and the foam body 314, into contact with the upper surface of the channel 316 so that the upper end of posts 326 and 328 protrudes from the top wall 302 of the barrier unit 300. As best seen in FIG. 22, a nut 332 is welded or otherwise permanently connected within the hollow, lowermost end of post 326, (and post 328, not shown). Each nut 332 receives one end of an all-thread rod 334, which are threaded together to secure the mounting posts 326, 328 atop the channel 316. A second nut 336 may be mounted to the top wall of the C-shaped channel 316, which receives the all-thread rod 334 to connect the mounting posts 326, 328, channel 316 and rod 334 together.

In the embodiment of the barrier units 300 shown in FIG. 21, the lower portion of the all-thread rod 334 is embedded within a layer of concrete or other internal ballast weight 338 located within the hollow interior 312 of the barrier unit 300 along the bottom wall 304. Alternatively, as shown in FIG. 22, an external ballast weight 340 in the form of a layer of concrete or a slab of metal may be mounted to the bottom wall 304 outside of the hollow interior 312. In this embodiment, the all-thread rod 334 extends through both the bottom wall 304 of the barrier unit 300 and the external ballast weight 340, where a third nut 342 attaches to the lowermost end of the rod 334 to secure the external ballast weight 340 to the barrier unit 300.

As shown in FIG. 22, when employing an external ballast weight 340 such that the lowermost end of the all-thread rod 324 projects from the bottom wall 304 of the barrier unit 300, a support tube 344 or post may also be threaded onto the exposed end of the rod 324 in order to mount accessories 343 underneath the barrier unit 300 for insertion into the water. Such accessories 343 may include nets, fencing and the various other accessories such as those supported at the upper end of the mounting posts 326, 328.

Figure 23:
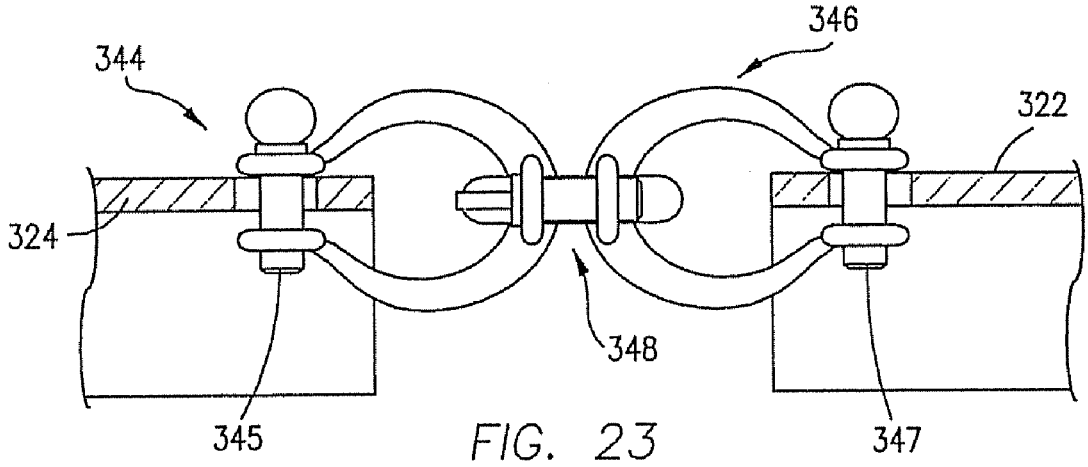
FIG. 23 is an enlarged view of one embodiment of the couplers for connecting two barrier devices end-to-end.
Figure 24:
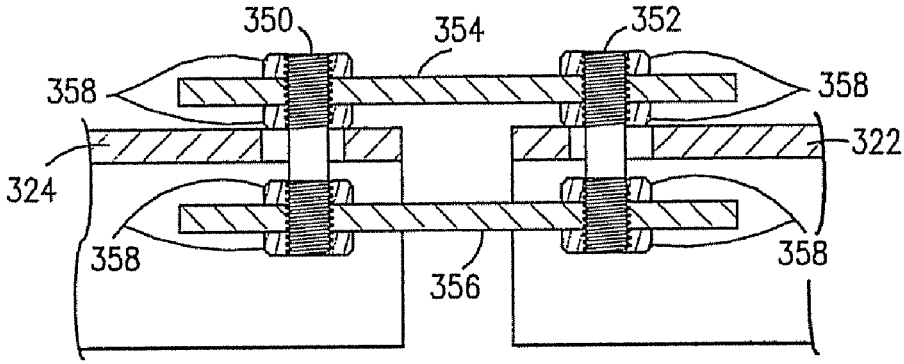
FIG. 24 is a view similar to FIG. 23 except of an alternative embodiment of the couplers herein.
Figure 25:
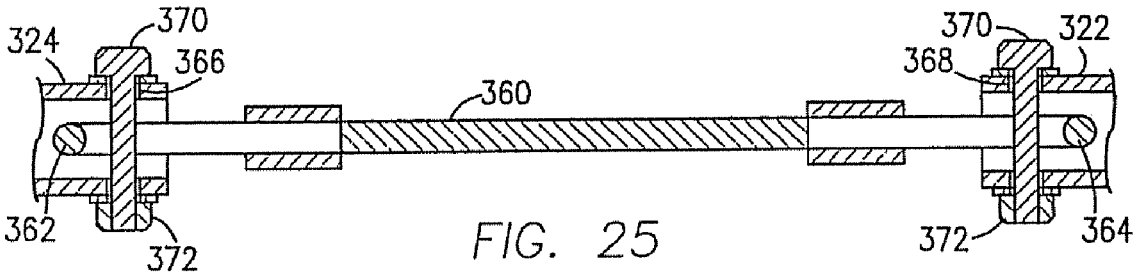
FIG. 25 is a view of a still further embodiment of the couplers of this invention.

Referring now to FIGS. 23-25, alternative two embodiments of coupling devices are illustrated for mounting one barrier unit 300 to an adjacent one. In the embodiment of FIG. 23, a first shackle 344 is secured by a bolt 345 to the protruding end 324 of the pipe 316 of one barrier unit 300, a second shackle 346 is secured by a bolt 347 to the protruding end 322 of the channel 316 of an adjacent unit 300 and a third shackle 348 is connected between the first and second shackles 344, 346.

The coupling device depicted in the embodiment of FIG. 24 consists of a first rod 350 inserted through a hole formed in the end 324 of the channel 316 of one barrier unit 300, and a second rod 352 inserted through a hole in the end 322 of the channel 316 of an adjacent unit 300. Each of the first and second rods 350, 352 are threaded at opposite ends. An upper connector bar 354 and a lower connector bar 356 span the ends 322, 324 of the two barrier units 300, and have holes which receive a respective, threaded end of each rod 350 and 352. Nuts 358 are threaded onto the bolts 350, 352, on either side of the bars 354 and 356, to secure the bars to the channels 316 of each barrier unit 300.

A third embodiment of a coupling device for the barriers 300 is shown in FIG. 25. A length of cable 360 having eyelets 362 and 364 at opposite ends spans the distance between the protruding ends of the pipe 316 of adjacent barriers 300. The eyelet 362 is aligned with a bore 366 formed in the end 324 of the pipe 316 of one barrier 300, and the eyelet 364 is aligned with a bore 368 formed in the end 322 of pipe 316 of an adjacent barrier. The eyelets 362, 364 are connected to the channel ends 322 and 324 by a bolt 370 and nut 372. Although a cable 360 is shown in FIG. 25, it should be understood that a rope, chain or similar connector could be employed.

The coupling devices shown in FIGS. 23-25 are intended to allow adjacent barrier units 300 to move with respect to one another without creating wear on the protruding ends 322 and 324 of the pipes 316 of adjacent barrier units 300. It is expected that the shackles 344, 346 and 348, of FIG. 23, the bolts 350, 352 and connector bars 354, 356 of FIG. 24, and, the cable 360 and bolts 370 of FIG. 25 all will exhibit wear as a result of movement of the barrier units 300 in the water, but all of these parts can be readily replaced during routine maintenance. Preferably, all of the parts forming the coupling devices are made of a relatively soft metal, compared to the hardened galvanized steel forming the pipes 316, so that they wear first and do not damage the pipes 316 which are much more difficult to repair or replace.

Figure 26:
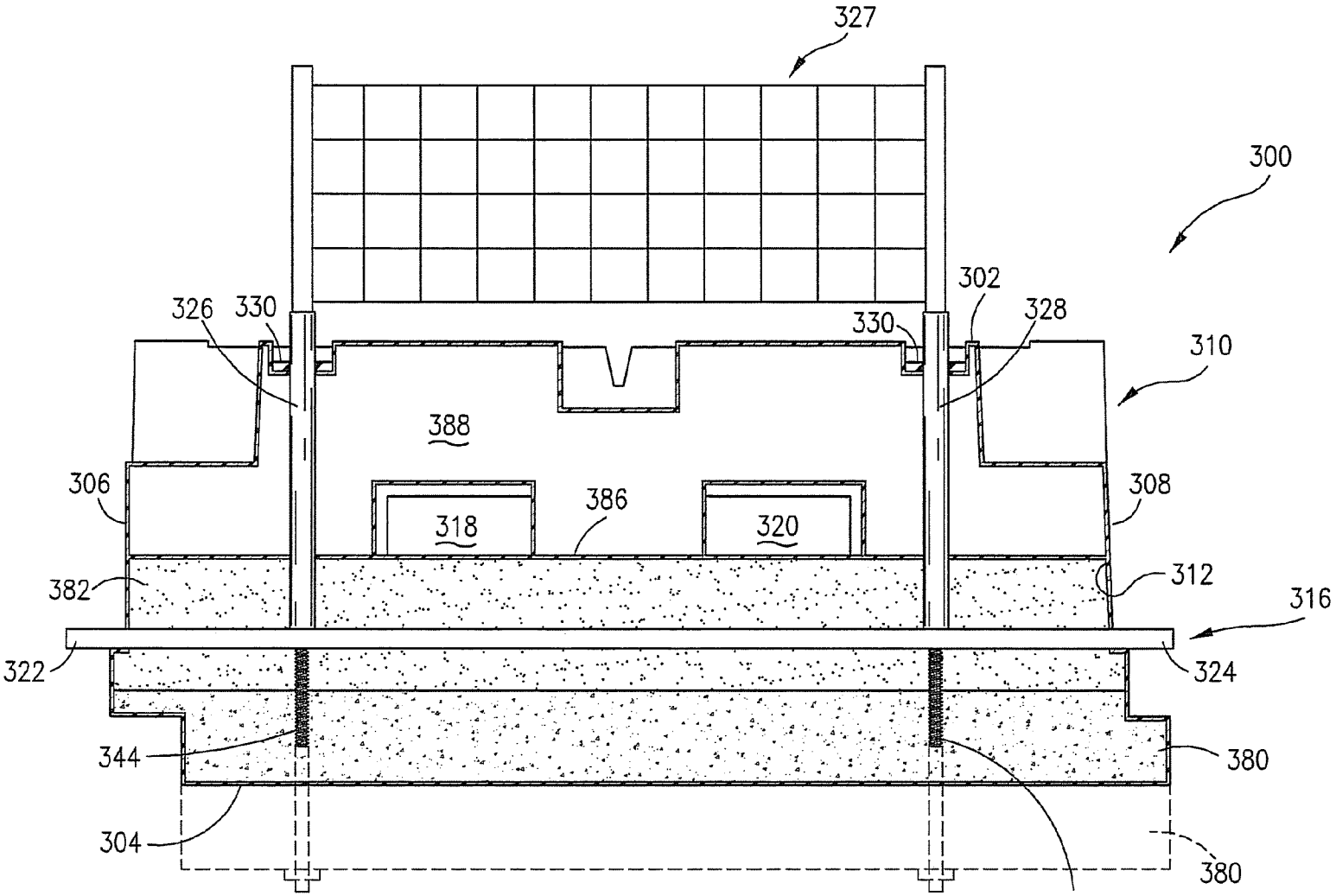
FIG. 26 is a view similar to FIG. 21 except with an internal ballast cavity and a separate ballast weight.
Figure 27:
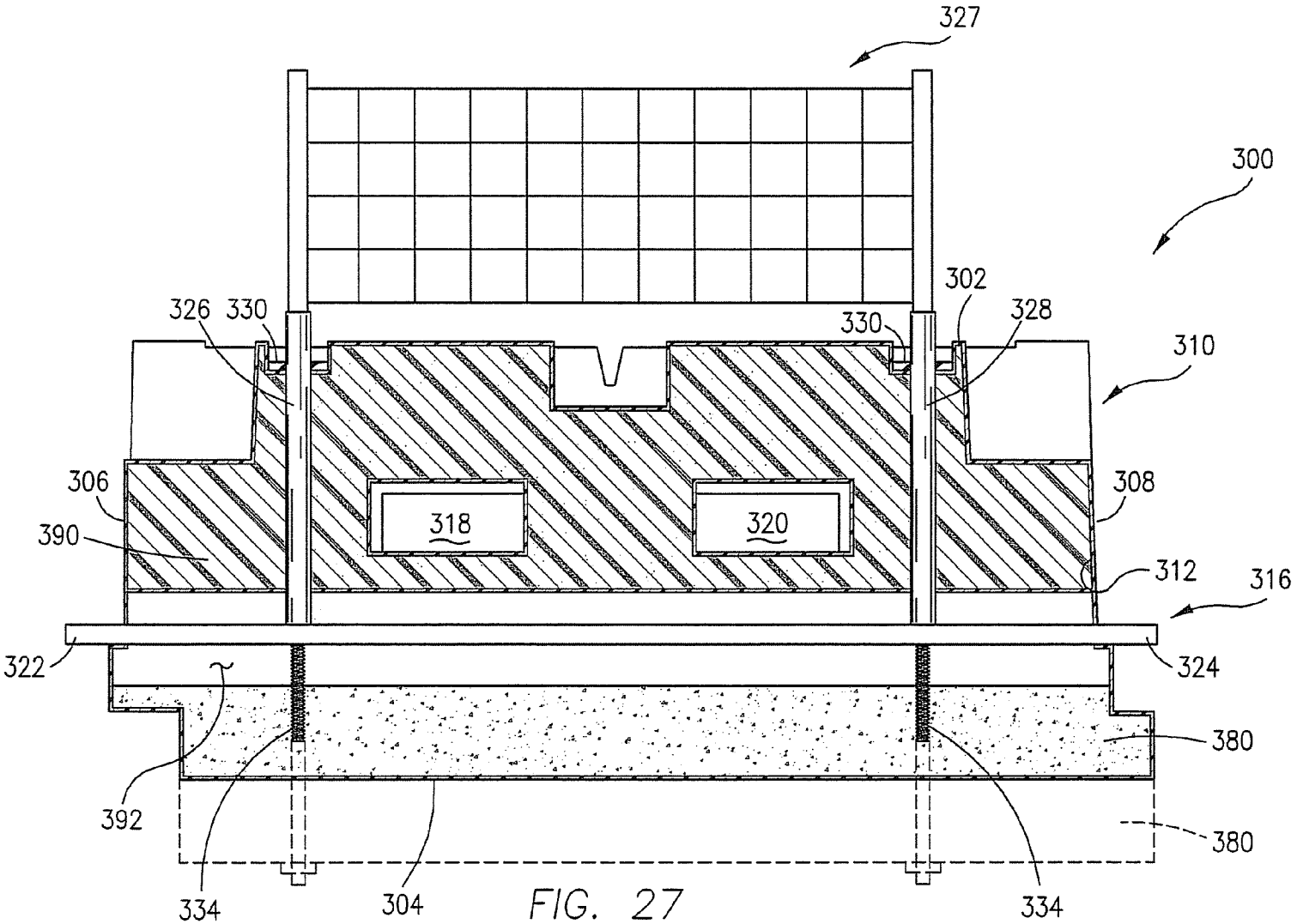
FIG. 27 is an alternative embodiment of an internal ballast structure of this invention depicted in a view similar to FIG. 26.

Barrier Units of FIGS. 26 and 27

In the barrier units 10, 110, 120 and 300 described above, a variety of ballast weights are employed to stabilize the barrier units in the water and maintain them in an upright position. Whether the ballast weight is formed of a layer of concrete, a slab of metal, a pipe or the like, located inside or outside of the hollow interior of the barrier, the amount of weight required to enhance the stability of the barrier units is substantial. Excess weight can present a problem with the deployment of the barrier units in the water, and is also undesirable for naval applications where the units are transported by a vessel and employed as a protective wall upon docking at a port or other location.

Referring now to FIGS. 26 and 27, alternative embodiments are illustrated which depict a barrier unit 300 modified to reduce the weight of the "permanent" ballast. It should be understood that while a barrier unit 300 is shown and described in FIGS. 26 and 27, the modifications described below to reduce the weight of permanent ballast are equally applicable to the barrier 10, 110 and 120 herein.

In the embodiment of FIG. 26, a permanent ballast weight 380 is depicted in both solid line and phantom lines at the base of the barrier 300. The permanent ballast weight 380 may be located within the interior 312 of the barrier 300 along its bottom wall 304 as in the embodiment of FIG. 21, in which case the threaded rod 334 is embedded in the permanent ballast weight 380. See solid lines of FIG. 26. Alternatively, as shown in phantom lines in FIG. 26, the permanent ballast weight 380 may be mounted on the outside of barrier 300 along its bottom wall 304 and connected to threaded rod 334 in the same manner as FIG. 22. Immediately above the permanent ballast weight 380 is a body of porous ballast material 382 which occupies a lower portion of the hollow interior 312. The porous ballast material 382 either rests upon the ballast weight 380, or along the bottom wall 304 of the barrier 300, depending upon whether the ballast weight 380 is located inside or outside of the hollow interior 312. One or more openings are formed in each of the end walls 306 and 308 in position to permit sea water to enter the hollow interior 312 and substantially completely impregnate the porous ballast material 382. The upper surface 386 of the body of porous ballast material 382 is water tight to prevent water from entering the remainder of the hollow interior 312, which forms an open cavity 388. Upon placement of the barrier device 300 in the water, the body of porous ballast material 382 impregnated with water adds sufficient amount of weight so that the total weight of the permanent ballast weight 380 can be much less than in the previous embodiments. This makes the transport and handling of the barrier units 300 much easier. When the barrier units 300 are taken out of the water, all of the water within the body of porous ballast material 382 is allowed to drain.

With reference to FIG. 27, an alternative embodiment of reducing the weight of the ballast units 300 is shown. A permanent ballast weight 380 is provided which may be located either inside or outside of the hollow interior 312, as described above in connection with a discussion of FIG. 26. Instead of the foam body 314 employed in the barrier units 300 depicted in FIGS. 21 and 22, a foam body 390 is provided which extends from the top wall 302 to a location short of the bottom wall 304 thus defining an open cavity 392 at the bottom portion of the hollow interior 312. This open cavity 392 extends either to the top of the permanent ballast weight 380, or to the bottom wall 304 of the barrier 300, depending upon whether the ballast weight 380 is located inside or outside of the hollow interior 312. At least one opening is formed in each end wall 306, 308 of the barrier unit 300 which allow the passage of water into the cavity 392 when the unit 300 is deployed. As in the embodiment illustrated in FIG. 26, the combined weight of the permanent ballast weight 380 and the water allowed within the hollow interior 312 of the unit 300, e.g. within the cavity 392, provides sufficient stability and maintain the unit 300 upright in the Water. The water is simply drained from the cavity 392 through the opening(s) when the barrier units 300 are removed from the water, thus providing a much lighter structure for handling and transport.

Figure 28:
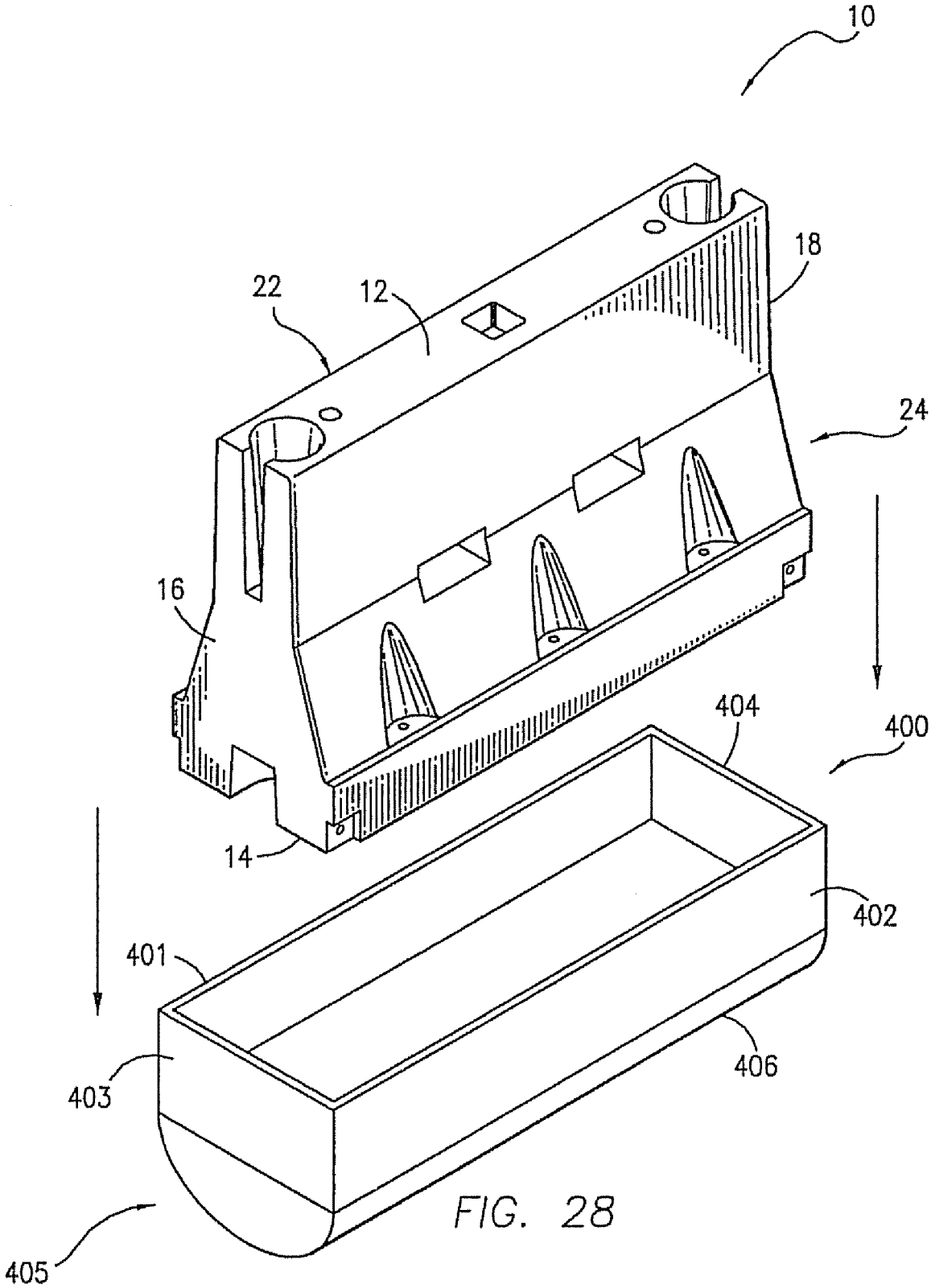
FIG. 28 is a perspective, exploded view of an alternative embodiment of this invention, employing a tray having the general shape of a boat bottom.

Embodiment of FIG. 28

In the embodiment of FIGS. 7-9 described above, a barrier unit 110 is illustrated with a bottom wall 112 having a shape similar to the hull of a vessel. This construction has the advantages of improved stability, ease of movement in the water when towed and others, but requires a separate mold to form the barrier unit 110 with the hull-shaped bottom wall 112.

Essentially the same advantages are obtained with the embodiment of FIG. 28 in which a tray 400 is provided having opposed side walls 401, 402, opposed end walls 403, 404 and a bottom wall 405 with a bottom surface 406 formed in the shape of the hull of a vessel. The open interior of the tray 400 is dimensioned to receive and support the flat bottom tall 14 or 304 of a barrier unit 10 or 300, respectively, thus eliminating the need to change the mold used to form such units 10, 300 while obtaining the advantages noted above. The barrier units 10 or 300 are strapped, bolted or otherwise removably affixed to the tray 400. Adjacent barrier units 10 or 300 are connected together end-to-end in the same manner as described above.

Embodiments of FIGS. 29-32

Still further embodiments of a barrier unit 410 and 412 according to this invention are shown in FIGS. 29 and 30, respectively. The barrier units 410 and 412 of FIGS. 29 and 30 are similar to the unit 300 described above in connection with a discussion of FIG. 21, and the same reference numbers are used to identify common structure. The primary difference between the barriers 300, and 410, 412 is the inclusion of one or more cables 414 in the barriers 410 and 412 which are either embedded within the foam body 314, as shown in FIGS. 29 and 30, or located within a seat formed in one of both of the side walls of the barriers 410, 412 as depicted in FIGS. 31 and 31A. FIG. 31 schematically depicts a cross sectional view of a portion of a side wall and foam body 314 of the barriers 410 and 412, showing the cables 414 carried within a seat in the side wall. In the embodiments of FIGS. 29 and 30, a total of three cables 414 are employed, which are generally horizontally oriented and vertically spaced from one another. The cables 414 extend between the end walls 306, 308 of barrier 410 at a location above the fork lift holes 318 and 320. Each cable 414 is formed with an eyelet 420 at opposite ends. The cables 414 of one barrier unit 410 are connected to the cables 414 of an adjacent barrier unit 410 in the same fashion shown in FIG. 25 and described above. It should be understood that while three cables 414 are illustrated in FIG. 29, less or more than such number could be used.

The barrier unit 412 shown in FIG. 31 is the same as barrier unit 410, except it is formed without the plastic shell forming the walls 302, 304, 306, 308 and the side walls of barrier unit 410. In this embodiment, the foam body 314 is exposed, and its outer surface defines a top wall 430, a bottom wall 432, opposed end walls 434 and 436, and side walls (not shown). The ballast weight 338 is connected by the rods 334 directly to the bottom wall 432, as in the embodiment of FIG. 21.

The primary advantage of the barrier units 410 and 412 is the increased "stopping power" they provide against relatively small boats or other water borne threats. The barrier units 410, 412 are intended to carry the cables 414 above the surface of the water, much like the embodiments of barrier unit 10 shown in FIGS. 16 and 17, so that they are impacted by a boat or other floating threat to stop it or at least get tangled up with the screw of the vessel to impede its progress. It is contemplated that the cables 414 of the end-most barrier units 410, 412 forming a barrier wall 150 would be fixed to a pier 157 or other permanent structure, as shown in FIG. 1, to provide the necessary resistance upon impact with a vessel.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A floating barrier unit, comprising:

a housing having a top wall, a bottom wall, opposed side walls, and opposed end walls defining a hollow interior, said hollow interior being formed with at least one opening;

a body of foam material located within said hollow interior;

at least one cable connected to said housing and extending between said opposed end walls;

a reinforcing member extending through said hollow interior of said housing between said opposed end walls;

a mounting post having an outer portion and an inner portion, said inner portion of said mounting post being inserted through said opening in said housing into engagement with said reinforcing member, said outer portion of said mounting post being adapted to mount at least one accessory item; and a ballast weight connected to said housing, said ballast weight being effective to maintain said outer portion of said mounting post out of the water when said housing is placed in the water.

2. The floating barrier unit of claim 1 in which said at least one cable is located within said hollow interior and embedded in said body of foam material.

3. The floating barrier unit of claim 1 in which at least one of said side walls is formed with at least one seat located externally of said hollow interior, said at least one cable being mounted in said at least one seat.

4. The floating barrier unit of claim 1 in which said at least one cable has opposed ends each of which protrude from one of said end walls of said housing, said opposed ends each being adapted to connect to a coupling device.

* * * * *